US007980430B2

(12) United States Patent
Hickok et al.

(10) Patent No.: US 7,980,430 B2
(45) Date of Patent: Jul. 19, 2011

(54) VALVE CARRIER RING ASSEMBLY

(75) Inventors: Alan P. Hickok, Mukwonago, WI (US); Kelly A. Smith, East Troy, WI (US)

(73) Assignee: Seaquist Closures L.L.C., Mukwonago, WI (US)

( * ) Notice: Subject to any disclaimer, the term of this patent is extended or adjusted under 35 U.S.C. 154(b) by 1150 days.

(21) Appl. No.: 11/655,522

(22) Filed: Jan. 19, 2007

(65) Prior Publication Data

US 2008/0173677 A1 Jul. 24, 2008

(51) Int. Cl.
*B65D 47/08* (2006.01)
*B65D 35/50* (2006.01)
*B65D 35/52* (2006.01)

(52) U.S. Cl. ..... 222/490; 222/494; 222/556

(58) Field of Classification Search ..... 222/494, 222/490, 556
See application file for complete search history.

(56) References Cited

U.S. PATENT DOCUMENTS 4,468,367 A 8/1984 Beune et al.
5,409,144 A 4/1995 Brown
5,531,363 A 7/1996 Gross et al.
5,680,969 A 10/1997 Gross
5,904,275 A 5/1999 Suffa
6,786,363 B1 * 9/2004 Lohrman ..... 222/494

FOREIGN PATENT DOCUMENTS

EP 1 131 252 B1 7/2002
EP 1531130 A1 * 5/2005
EP 1 802 533 B1 7/2007

OTHER PUBLICATIONS

Drawing A.
Drawing B.
Drawing C.
Drawing D.
International Preliminary Search Report and Written Opinion in international application Serial No. PCT/US2008/000199.

* cited by examiner

*Primary Examiner* — Kenneth Bomberg
(74) *Attorney, Agent, or Firm* — Wood, Phillips, Katz, Clark & Mortimer

(57) ABSTRACT

A carrier ring assembly is provided for use with a closure for a container. The carrier ring assembly includes a carrier ring and a valve. The carrier ring includes a retention bead and a retention space. The valve is located at least partially within the carrier ring and has a retention portion positioned within the retention space.

19 Claims, 22 Drawing Sheets

VALVE CARRIER RING ASSEMBLY

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to components of a closure for a container. More particularly, the invention relates to a valve and carrier ring which are insertable into the body of a closure.

BACKGROUND OF THE INVENTION AND TECHNICAL PROBLEMS POSED BY THE PRIOR ART

Containers and closures may be utilized for dispensing a wide variety of substances such as liquids, gels, suspensions and the like from the container as known by those skilled in the art. It has been known to use closures with pressure-actuated, flexible, slit-type valves to dispense the contained substance as pressure is applied to the container. It is also known to utilize carrier rings whereby the valve may be inserted into the carrier ring to form a preassembled carrier ring assembly which may then be inserted into the closure (e.g., see U.S. Pat. No. 5,531,363). This preassembled structure can be advantageous for manufacturing processes as the carrier ring assembly may be assembled at a separate location from the final assembly of the closure on the container.

However, known carrier ring assemblies have problems. Specifically, the carrier ring assemblies generally require additional substances, such as talc, to aid assembly of the valve into the carrier ring assembly. Talc is used as the valve must be squeezed into a specific orientation in the carrier ring such that the valve is retained within the carrier ring. These substances can be problematic for the machines used in the assembly process, frequently requiring disassembly, cleaning and/or replacement of the machinery, due to substances like talc.

Alternatively, valves can be inserted into carrier rings using less talc, but requiring an additional processing step whereby a portion of the carrier ring is pressed over the top of the valve to retain the valve in the carrier ring. These additional processing steps similarly slow the manufacturing process down and require additional machinery.

BRIEF SUMMARY OF THE INVENTION

The benefits and advantages described above are realized by the present invention which provides a valve carrier ring assembly for use with a closure of a container. The valve carrier ring assembly includes a carrier ring and a valve. The carrier ring is a unitary structure and includes a dispensing passage, a plurality of separate retaining beads and a plurality of retaining spaces. The dispensing passage is defined by a wall having a top portion. The plurality of retaining beads are each located adjacent the top portion of the wall. The plurality of retaining spaces are each defined at least in part by the top portion of the wall and one of the plurality of retaining beads. The valve is located at least partially within the carrier ring and includes a dispensing portion and a retention portion. At least part of the retention portion is located substantially within the plurality of retaining spaces.

In one form, a closure for an opening to a container is provided. The closure includes a hollow body and a valve carrier ring assembly. The hollow body can engage the container around the opening and has a dispensing opening for communicating with the container opening. The valve carrier ring assembly is located within the body adjacent the dispensing opening and has a carrier ring and a valve. The carrier ring is a unitary structure and includes a dispensing passage, a plurality of separate retaining beads and a plurality of retaining spaces. The dispensing passage is defined by a wall having a top portion. The plurality of retaining beads are each located adjacent the top portion of the wall. Each retaining space is defined at least in part by the top portion of the wall and one of the plurality of retaining beads. The valve is located at least partially within the carrier ring and includes a dispensing portion and a retention portion. At least part of the retention portion is located substantially within the plurality of retaining spaces.

In another form, a valve carrier ring assembly for use with a closure of a container is provided. The valve carrier ring assembly includes a carrier ring and a valve. The carrier ring is a unitary structure and includes a dispensing passage, at least one retaining bead and at least one retaining space. The dispensing passage is defined by a wall having a top portion. The at least one retaining bead is located adjacent the top portion of the wall. The at least one retaining space is defined at least in part by the top portion of the wall and the at least one retaining bead. The valve is located at least partially within the carrier ring and includes a dispensing portion and a retention portion. The retention portion has a closure sealing surface and a carrier ring sealing surface. At least a part of the retention portion is positioned within the at least one retaining space. According to yet another form, a closure for an opening to a container is provided. The closure includes a hollow body and a valve carrier ring assembly. The hollow body for engages the container around the opening and has a dispensing opening for communicating with the container opening. The valve carrier ring assembly is located within the body adjacent the dispensing opening and has a carrier ring and a valve. The carrier ring is a unitary structure and includes a dispensing passage, at least one retaining bead and at least one retaining space. The dispensing passage is defined by a wall having a top portion. The at least one retaining bead is located adjacent the top portion of the wall. The at least one retaining space is defined at least in part by the top portion of the wall and the at least one retaining bead. The valve is located at least partially within the carrier ring and includes a dispensing portion and a retention portion. The retention portion has a closure sealing surface, a carrier ring sealing surface, and a shoulder portion located between the closure sealing surface and the carrier ring sealing surface. At least a part of the retention portion is positioned within the at least one retaining space.

According to one form, the carrier ring includes two separate retaining beads.

In one form, the retaining beads are located oppositely on the carrier ring.

In accordance with one form, the top portion of the wall of the carrier ring is indirectly connected to the plurality of retaining beads through a bridge. In one form, top portion of the wall is generally frustoconical.

According to one form, the valve retention portion is resilient to facilitate assembly.

According to one form, the valve is loosely retained in the retaining spaces.

In one form, the at least part of the retention portion comprises a recessed outer shoulder portion.

According to one form, the closure sealing surface is an upwardly facing frustoconical surface for contacting the closure, and the carrier ring sealing surface is a downwardly facing frusto-conical surface for contacting the carrier ring.

In accordance with one form, the closure further includes at least one closure retaining bead located on the hollow body to retain the valve carrier ring assembly adjacent the hollow body.

In one form, the closure further includes a spout sealing surface wherein the valve is compressed between the spout sealing surface and the top portion of the wall.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

In the accompanying drawings that form part of the specification, and in which like numerals are employed to designate like parts throughout the same.

DETAILED DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

It should be understood that the structure described herein below may be designed to cooperate with a container for dispensing a wide variety of substances. However, the present description and corresponding figures do not illustrate such a container as containers known to those skilled in the art may be readily adaptable to the structure described below.

A closure 36 is adapted to be mounted on a container (not illustrated) with a threaded engagement system. To this end, the container typically includes a conventional thread for being threadingly engaged by the closure 36.

Figure 1:
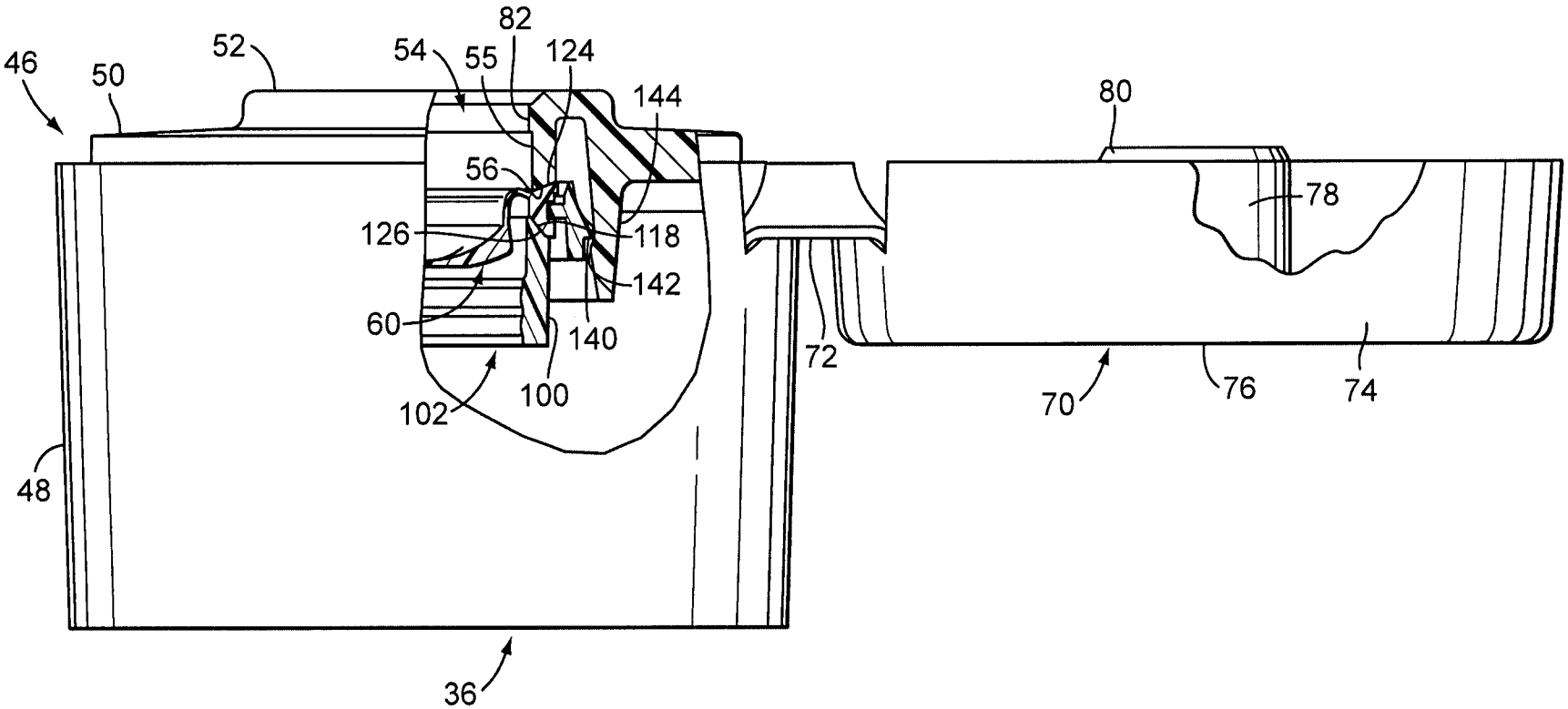
FIG. 1 is a side elevational view of a closure and a first form of a carrier ring assembly of the present invention with a portion broken away to reveal interior details.
Figure 2:
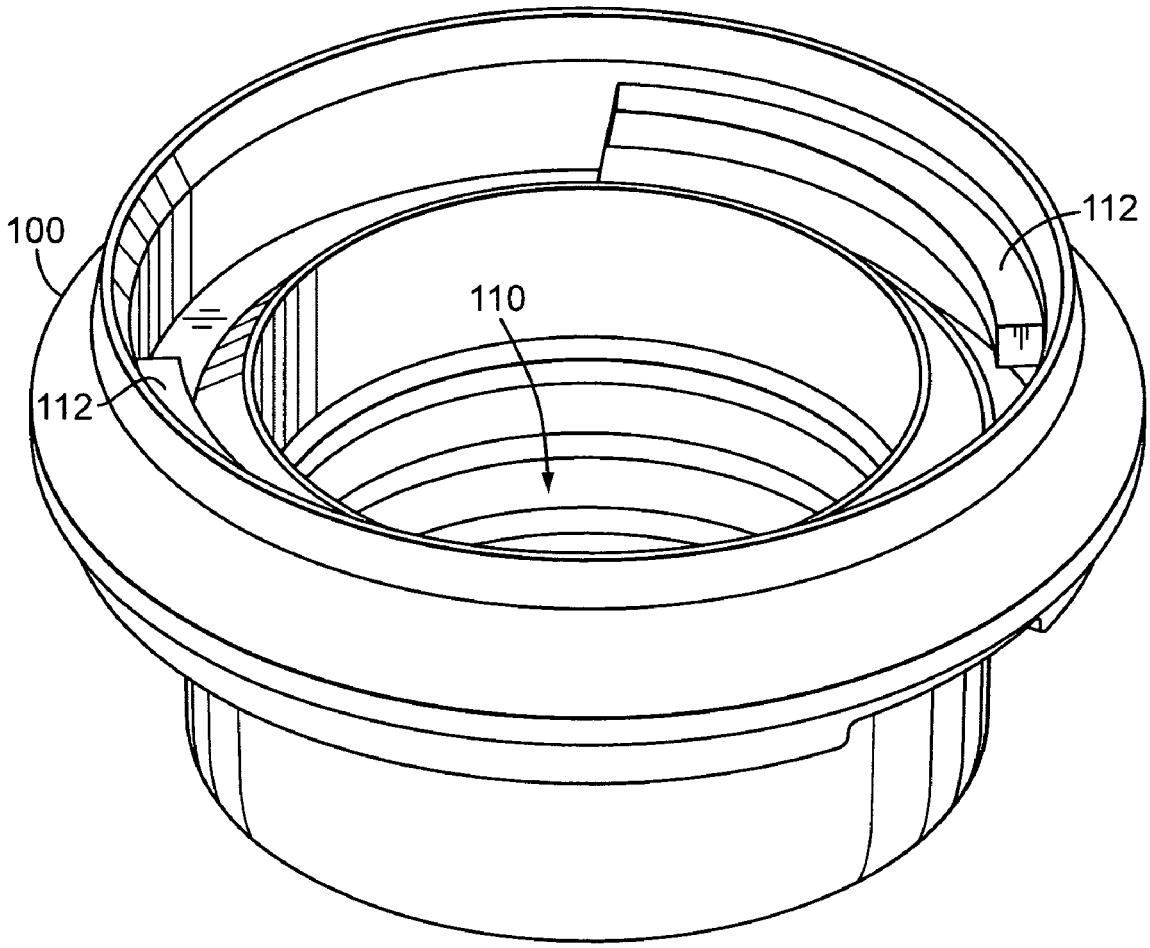
FIG. 2 is a top perspective view of a carrier ring prior to assembly with other components shown in FIG. 1.
Figure 3:
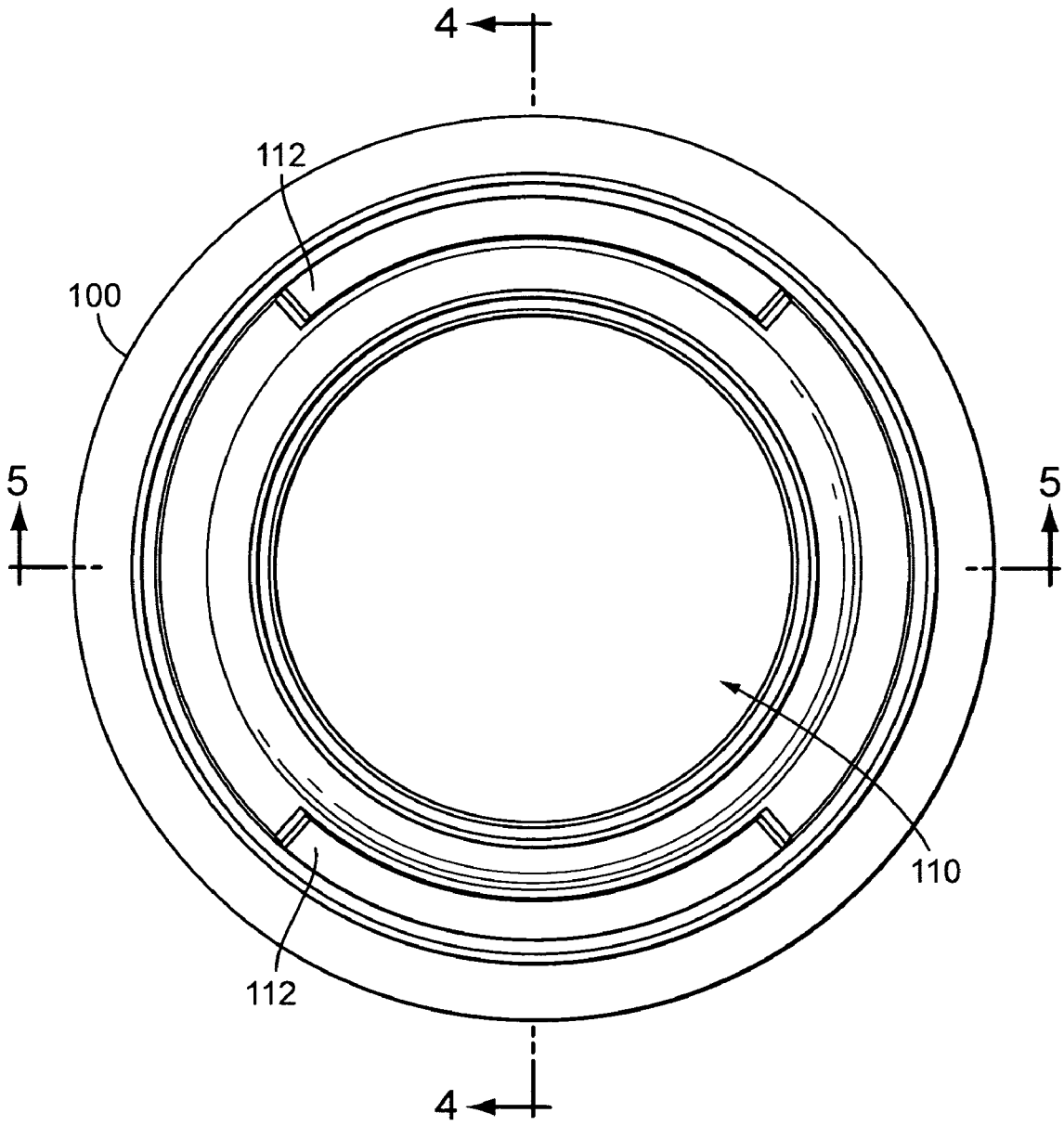
FIG. 3 is a top view of the carrier ring of FIG. 2.

As shown in FIG. 1, the closure 36 includes a closure body or base 46 and a lid 70 hingedly connected to the body 46. The body 46 has a peripheral skirt 48 depending downwardly from a deck 50. The center of the deck 50 merges into a upwardly projecting spout 52 which defines a dispensing orifice 54. The spout 52 is defined by an annular spout wall 55 which extends downwardly from the deck 50 and has a frustoconical spout sealing surface 56.

The closure 36 has an interior surface on which a thread (not shown) for threadingly engaging the container thread may be provided. The closure 36 could be mounted on the container with other attachment systems, such as cooperating, releasable beads, or beads and grooves, so as to retain the closure 36 and container together in a sealing relationship.

As can be seen in FIG. 1, the closure 36 includes a pressure-actuatable, flexible, slit-type valve 60 in a carrier ring 100. Together, with the valve 60 and carrier ring 100, comprise a carrier ring assembly 102 which is held inside the closure body 46 by means of a snap-fit system described in detail hereinafter. The valve 60 may be of the well-known type sold in the United States of America by Liquid Molding Systems, Inc., 2202 Ridgewood Dr., Midland, Mich. 48642, U.S.A., provided the periphery of the valve 60 is configured pursuant to the teachings of the present invention to accommodate the mounting of the valve as described in detail hereinafter.

The particular form of the valve 60 illustrated is molded as a unitary structure from material which is flexible, pliable, elastic, and resilient. This can include elastomers, such as a synthetic, thermosetting polymer, including silicone rubber, such as a silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 60 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Except for the outermost peripheral portion of the valve 60, the design configuration of valve 60, and the operating characteristics thereof, are substantially similar to the configuration and operating characteristics of the valve designated by the reference number 3*d* in the U.S. Pat. No. 5,409,144. The description in that patent is incorporated herein by reference to the extent pertinent and to the extent not inconsistent herewith.

Figure 6:
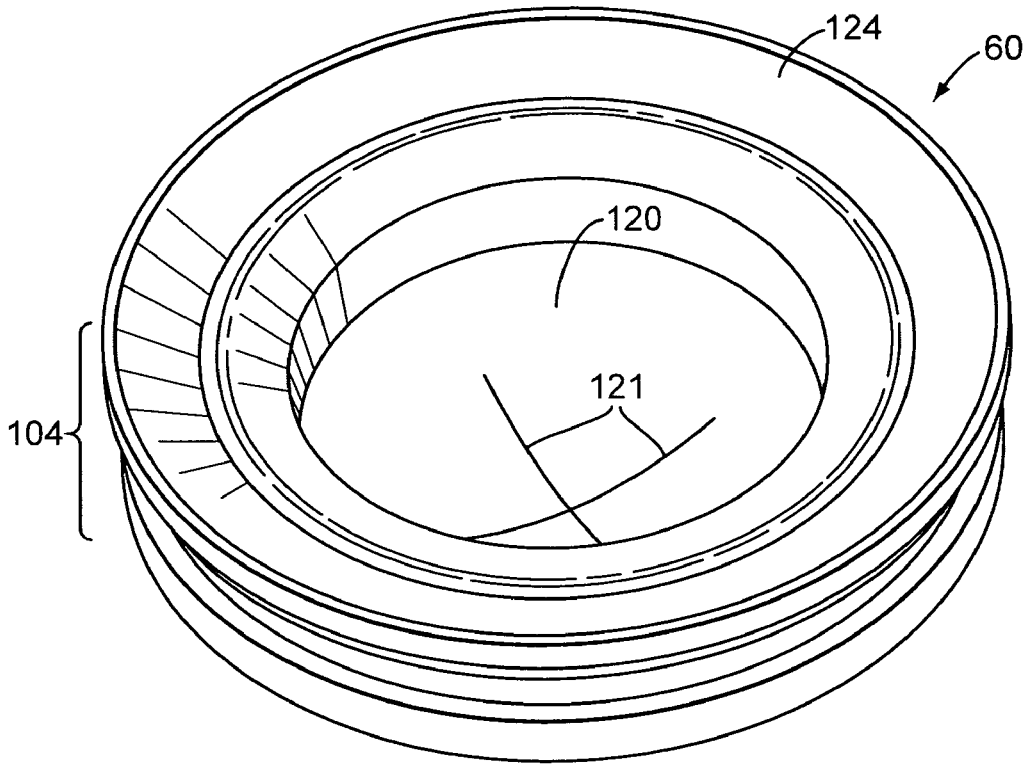
FIG. 6 is a top perspective view of a valve for use with a carrier ring as shown in FIG. 1.
Figure 7:
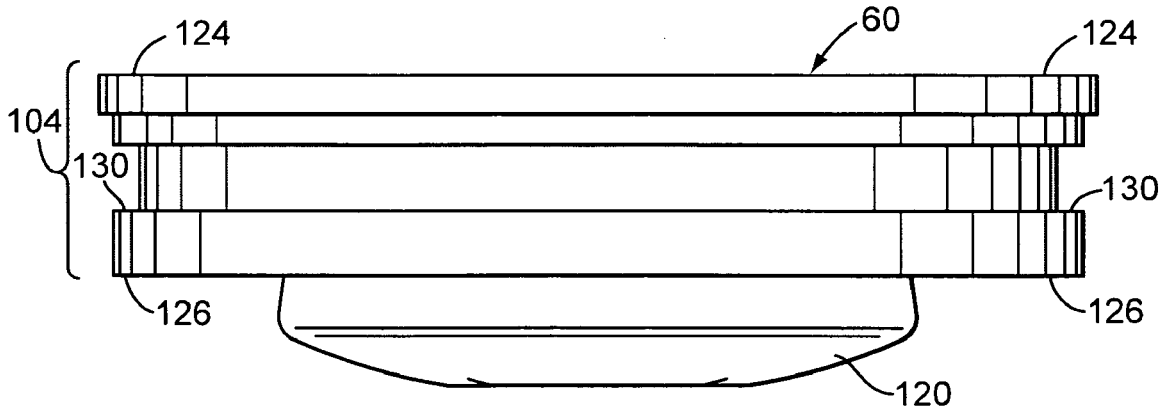
FIG. 7 is a side elevational view of the valve of FIG. 6.
Figure 8:
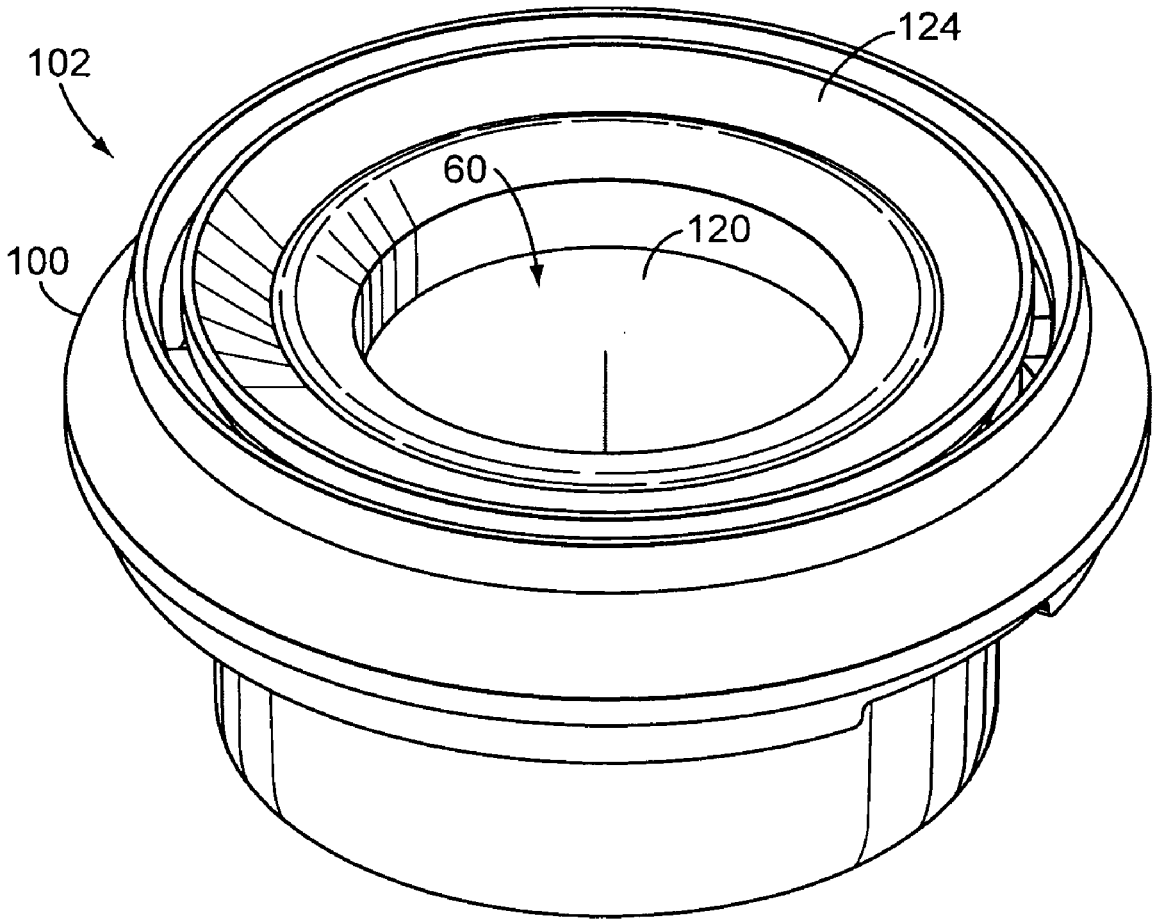
FIG. 8 is a top perspective view of an assembled carrier ring assembly which includes the carrier ring of FIGS. 2-5 and the valve of FIGS. 6-7.
Figure 9:
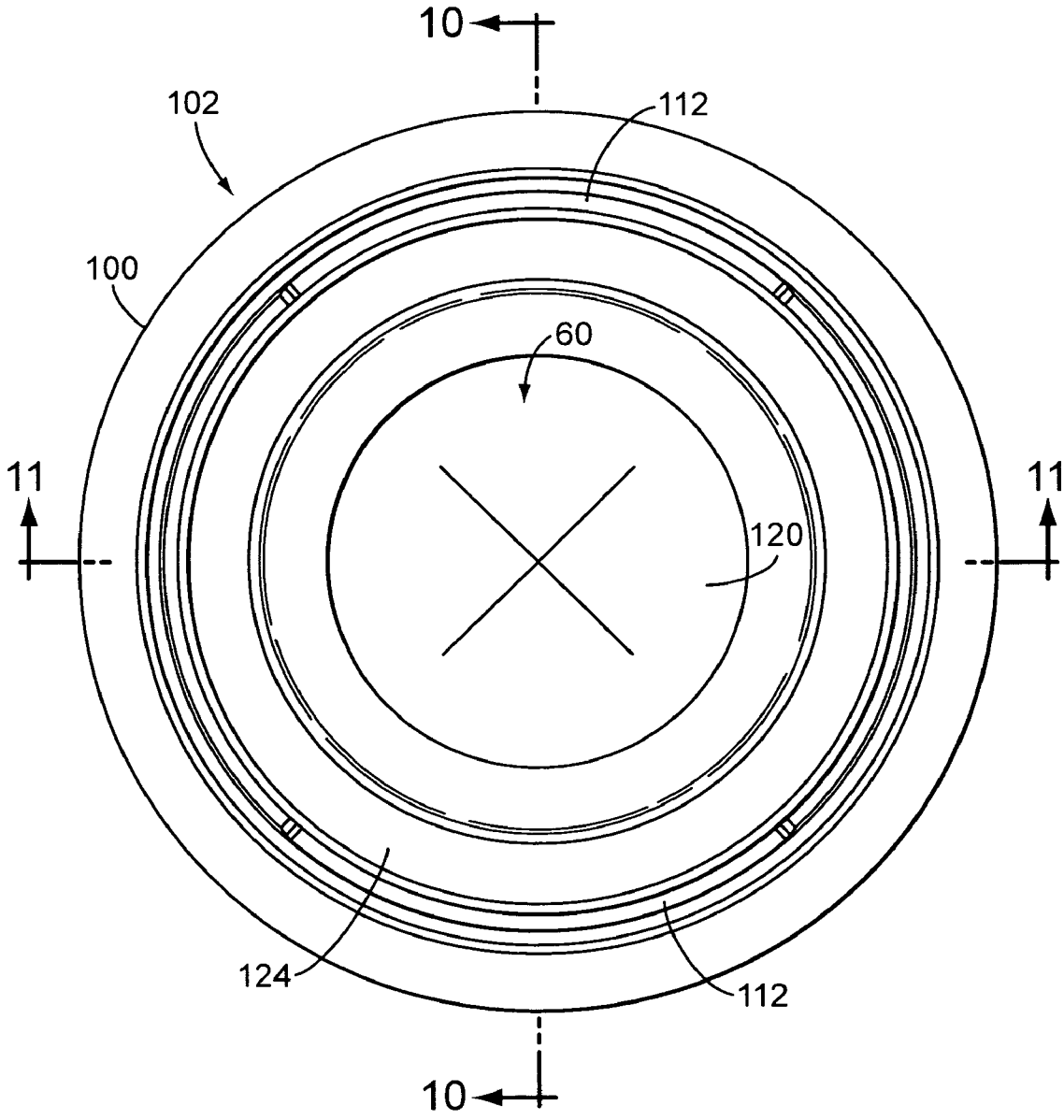
FIG. 9 is a top view of the assembled carrier ring assembly of FIG. 8.

The valve 60 includes a recessed, dispensing portion or central head 120 (FIGS. 6-11) which is flexible and which has an outwardly concave configuration (as viewed from the exterior of the valve 60 when the valve 60 is mounted in the spout 52). The head 120 defines two, mutually perpendicular, intersecting slits 121 (FIG. 6) of equal length extending through the head 120 to define a normally self-sealing, closed orifice. The intersecting slits define four, generally sector-shaped, flaps or petals in the head. The flaps open outwardly from the intersection point of the slits in response to an increasing pressure differential of sufficient magnitude in the well-known manner described in the above-discussed U.S. Pat. No. 5,409,144.

The valve 60 has an interior side for facing generally into the spout 52 and an exterior side for facing generally outwardly from the spout 52. The interior side of the valve 60 is adapted to be contacted by the fluid product in the container, and the exterior side of the valve 60 is exposed to the ambient external atmosphere when the lid 70 is opened.

The valve 60 includes a thin skirt which extends axially and radially outwardly from the central, recessed valve head 120. The outer end portion of the skirt terminates in an enlarged, much thicker, peripheral flange or retention portion 104 (FIGS. 6, 7, 10 and 11) which has a stepped, transverse cross section and which is received in the carrier ring 100 (described in detail hereinafter).

When the valve 60 is properly disposed in the carrier ring 100 in the spout 52, with the valve head 120 in the closed condition, the valve head 120 is recessed relative to the end of the spout 52. However, when the valve head 120 is forced outwardly from its recessed position by a sufficiently large pressure differential across the valve, the valve 60 opens. More specifically, after the closure lid 70 (described in detail hereinafter) has been opened, and when the pressure on the interior side of the valve 60 exceeds the external ambient pressure by a predetermined amount, the valve head is forced outwardly from the recessed or retracted position to an extended, open position (not shown).

During the valve opening process, the valve head 120 is initially displaced outwardly while still maintaining its generally concave, closed configuration. The initial outward displacement of the concave head 120 is accommodated by the relatively, thin, flexible, skirt. The skirt moves from a recessed, rest position to a pressurized position wherein the skirt extends outwardly toward the open end of the spout 52. However, the valve 60 does not open (i.e., the slits do not open) until the valve head 120 has moved substantially all the way to a fully extended position. Indeed, as the valve head 120 moves outwardly, the valve head 120 is subjected to radially inwardly directed compression forces which tend to further resist opening of the slits. Further, the valve head 120 generally retains its outwardly concave configuration as it moves forward and even after the sleeve reaches the fully extended position. However, when the internal pressure becomes sufficiently great compared to the external pressure, then the slits in the extended valve head 120 quickly open to dispense product.

As can be seen in FIG. 1, the preferred form of the lid 70 is hingedly connected to the closure body 46 with a snap-action type hinge 72. One form of such a snap-action type hinge 72 is described in the U.S. Pat. No. 6,321,923. Other types of hinges could be used. In some applications, the hinge could be omitted, and the lid 70 need not be connected to the body 46 at all.

As can be seen in FIG. 1, the lid 70 includes a peripheral skirt 74 which depends from a top wall 76. Projecting form the inside of the top wall 76 is a sealing spud 78 which has a frustoconical lead-in surface 80. The interior of the spout 52 may be characterized as defining a first sealing bead or engaging surface 82 (FIG. 1). The lid spud 78 may be characterized as an occlusion member for closing the spout 52 and engaging the spout first sealing bead or engaging surface 82.

When the lid 70 is closed, the distal end of the spud 78 is spaced just above the central head 120 of the valve 60. If the package is subjected to an over-pressure condition when the lid 70 is closed (such as if the container is impacted or squeezed), then the upward, outward movement of the head 120 of the valve 60 caused by such an internal over-pressure condition will be limited by engagement with the lid spud 78 so as to prevent the valve 60 from opening inside the closed lid 70.

One embodiment of the carrier ring assembly 102 will now be described in more detail below with reference to FIGS. 1-11. The carrier ring assembly includes the carrier ring 100 and the valve 60. The carrier ring 100 includes a dispensing passage 110, at least one retaining bead 112, and at least one retaining space 114. As best seen in FIGS. 2-5, the illustrated embodiment preferably includes two retaining beads 112 and two retaining spaces 114. However, it should be understood that the number of retaining beads 112 and retaining spaces 114 may be adjusted as desired. Furthermore, the retaining beads 112 are located substantially opposite one another on the carrier ring 100.

The dispensing passage 110 is defined by a wall 116 having a top portion 118. In the embodiment illustrated in FIGS. 4-5, the top portion 118 of the wall 116 is frustoconical. Also, it should be noted that the wall 116 may also include beads 119 which facilitate retention of the ring 100 on the mold assembly core component when the mold is opened after the thermoplastic material has been injected and cooled sufficiently. The at least one retaining bead 112 is located adjacent the top portion 118 of the wall 116. The at least one retaining space 114 (FIG. 4) is defined at least in part by the top portion 118 of the wall 116 and the at least one retaining bead 112. Furthermore, as understood from FIGS.3-5, the embodiment of the carrier ring 100, as illustrated, is a unitary structure. Specifically, while it might appear from a cursory inspection of FIG. 4 that the retaining beads 112 are detached from the wall 116, it should be understood from FIG. 5 that the retaining beads 112 are, in fact, indirectly attached to the wall 116 through a bridge 121 as a unitary structure.

The valve carrier ring assembly 102 is initially assembled by mounting the valve 60 in the carrier ring 100. As can be seen in FIGS. 1, 7, 10 and 11, the retention portion 104 of the valve 60 has a closure sealing surface 124 and a carrier ring sealing surface 126. The function of each of theses surfaces 124 and 126 will be discussed in more detail below with regards to the assembly and operation of the carrier ring assembly 102 and closure 36. The retention portion 104 of the valve 60 may also include a recessed outer shoulder portion 130 (FIGS. 7, 10, and 11) which is located between the closure sealing surface 124 and the carrier ring sealing surface 126. The actual operation of the valve dispensing the contents of the container was previously described supra, and therefore will not be discussed here.

Figure 10:
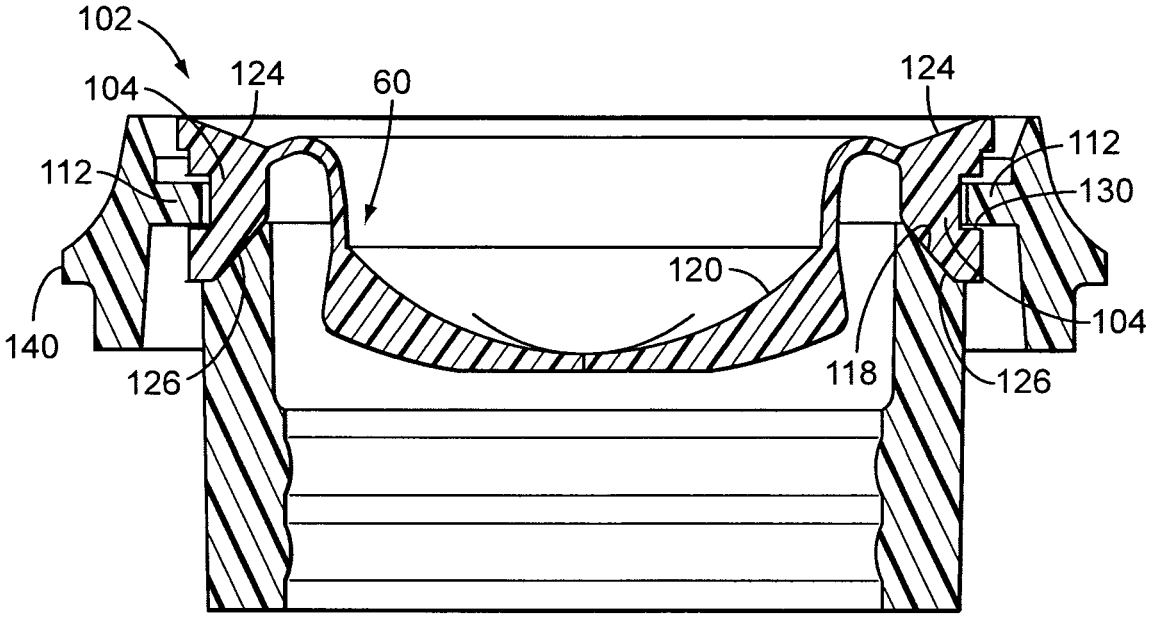
FIG. 10 is a cross-sectional view of the assembled carrier ring assembly taken along line 10-10 of FIG. 9.
Figure 11:
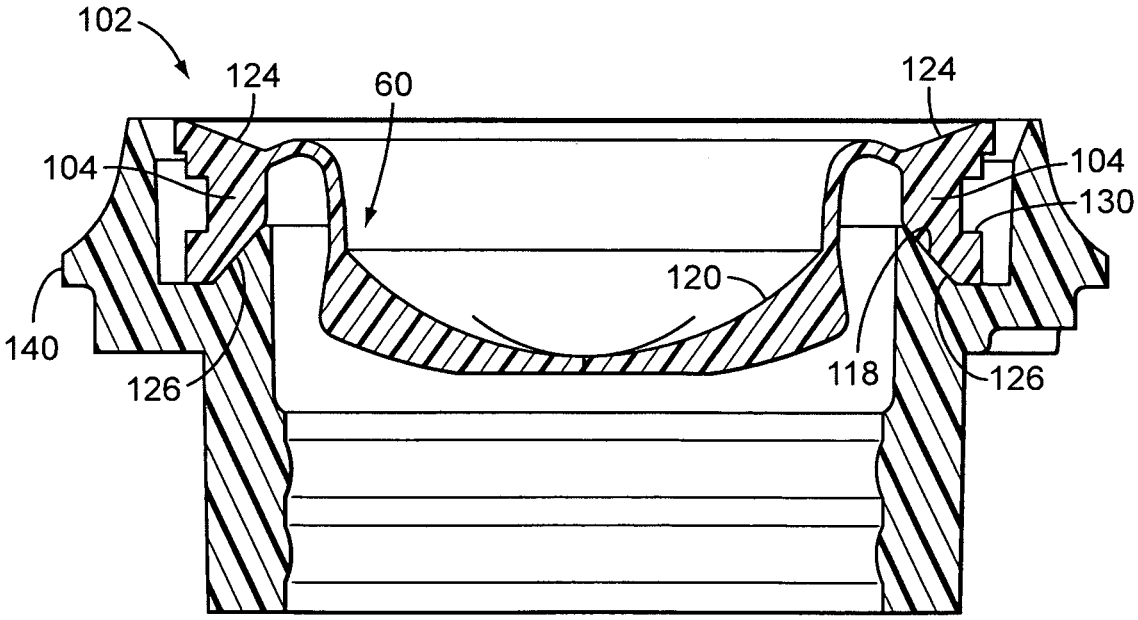
FIG. 11 is a cross-sectional view of the assembled carrier ring assembly taken along line 11-11 of FIG. 9.

The valve 60 is inserted into the carrier ring 100 such that the carrier ring sealing surface 126 must pass by the retaining beads 112. The retention portion 104 may be required to deform slightly to permit the carrier ring sealing surface 126 to pass by the retaining beads 112. This can readily occur if the valve 60 is molded from silicone rubber or other compliant material. Once past the retaining beads 112, at least a portion of the retention portion 104 is positioned within the retaining space 114 while the carrier ring sealing surface 126 will be located adjacent the top portion 118 of the wall 116 (FIGS. 10 and 11). The carrier ring sealing surface 126 of the valve 60 may contact the top portion 118, though it need not during this phase of the assembly. The valve shoulder portion 130 will be located adjacent the carrier ring retaining beads 112 while at least a portion of the closure sealing surface 124 of the valve 60 will remain exposed relative to the carrier ring 100 and associated structure (FIGS. 10 and 11). While the retaining beads 112 are shown opposite one another, it should be understood that the valve 60 need not have a specific orientation about its vertical axis within the carrier ring 100, but may be oriented if desired.

In one form of the invention, the valve 60 has a somewhat loose fit within the carrier ring 100 such that the valve retention portion 104 is not compressed by the retaining beads 112. As best seen in FIG. 10, there is a slight gap located between the beads 112 of the carrier ring 100 and the valve 60. The loose fit of the valve 60 can be utilized to permit easier assembly of the valve 60 within the carrier ring 100 and to thereby minimize, if not eliminate, the use of friction-reducing materials such as talc. Further, it is not required that a fluid-tight seal exist between the valve 60 and the carrier ring 100 prior to insertion of the carrier ring assembly 102 into the closure body 46 as no fluid will be dispensed prior completion of the assembly of the closure components.

Referring again to FIG. 1, the carrier ring assembly 102 is shown as inserted into the closure 36. The exterior of the carrier ring assembly 102 has an annular flange 140 (FIGS. 1, 10 and 11). As the assembly 102 is inserted into the closure body 46 (from the bottom end of the closure body 46), the flange 140 contacts a snap-fit bead 142 on an engagement structure or collar 144 located on the inside of the closure body 46. As the carrier ring assembly 102 is urged past the closure body bead 142, the flange 140 contacts the bead 142, thereby retaining the carrier ring assembly 102 within the closure body 46.

As can be seen in FIG. 1, once the carrier ring assembly 102 is fully inserted and retained within the closure 36, the spout sealing surface 56 of the closure body 46, contacts the closure sealing surface 124 of the valve retention portion 104 as the valve retention portion 104 is compressed. Additionally, the carrier ring 100, via the top portion 118 of the wall 116, contacts the carrier ring sealing surface 126 of the valve retention portion 104. Furthermore, it should be understood that the surfaces 56, 124, 126, as well as the top portion 118 of the wall 116, are preferably shaped so as to be complementary. More specifically, in one preferred form, the surfaces 56, 124, 126, as well as the top portion 118 of the wall 116, are frustoconical surfaces, wherein the closure sealing surface 124 of the valve 60 is upwardly facing and the carrier ring sealing surface 126 of the valve 60 is downwardly facing. These contacts or engagements between mating surfaces of the closure 36, the valve 60 and the carrier ring 100 provide a substantially fluid-tight connection preventing the contents of the container from leaking around the connection between the closure 36, the valve 60, and the carrier ring 100. The resulting assembled structure has the retention portion 104 of the valve 60 compressed between the spout sealing surface 56 and the top portion 118 of the wall 116.

Another embodiment is illustrated in FIGS. 12-22. Many of the structures found in this embodiment are similar to structures discussed previously and therefore share the same reference numerals. However, some of the structures are different and therefore, these reference numerals have been modified.

Figure 4:
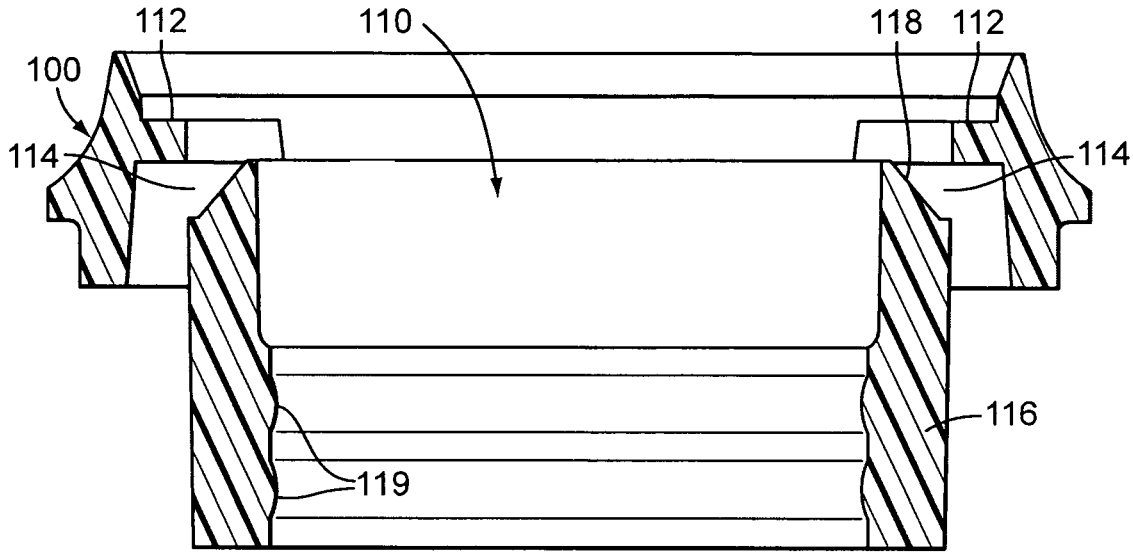
FIG. 4 is a cross-sectional view of the carrier ring taken along line 4-4 of FIG. 3.
Figure 5:
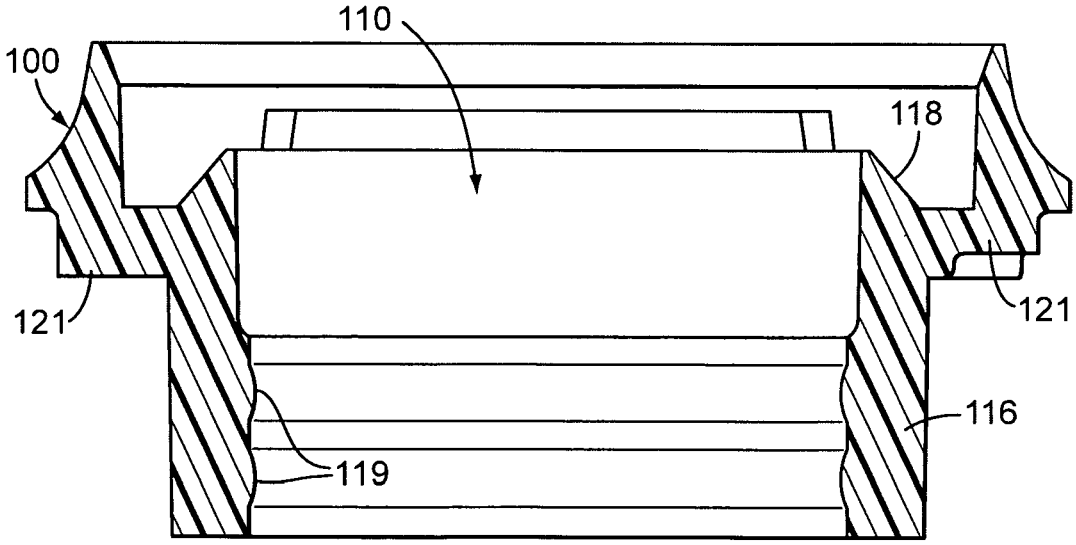
FIG. 5 is a cross-sectional view of the carrier ring taken along line 5-5 of FIG.3.
Figure 12:
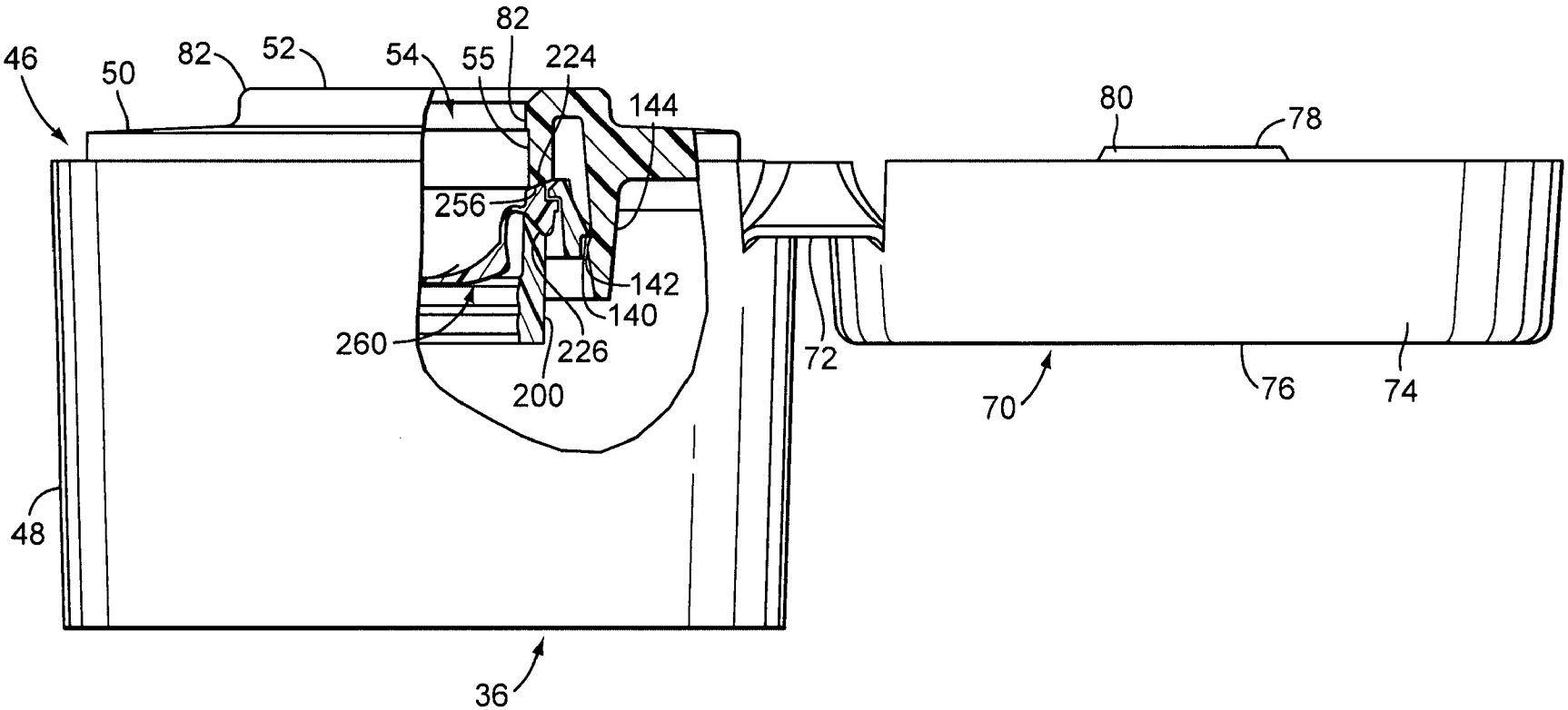
FIG. 12 is a side elevational view of a closure and a second form of a carrier ring assembly with a portion broken away to reveal interior details.
Figure 13:
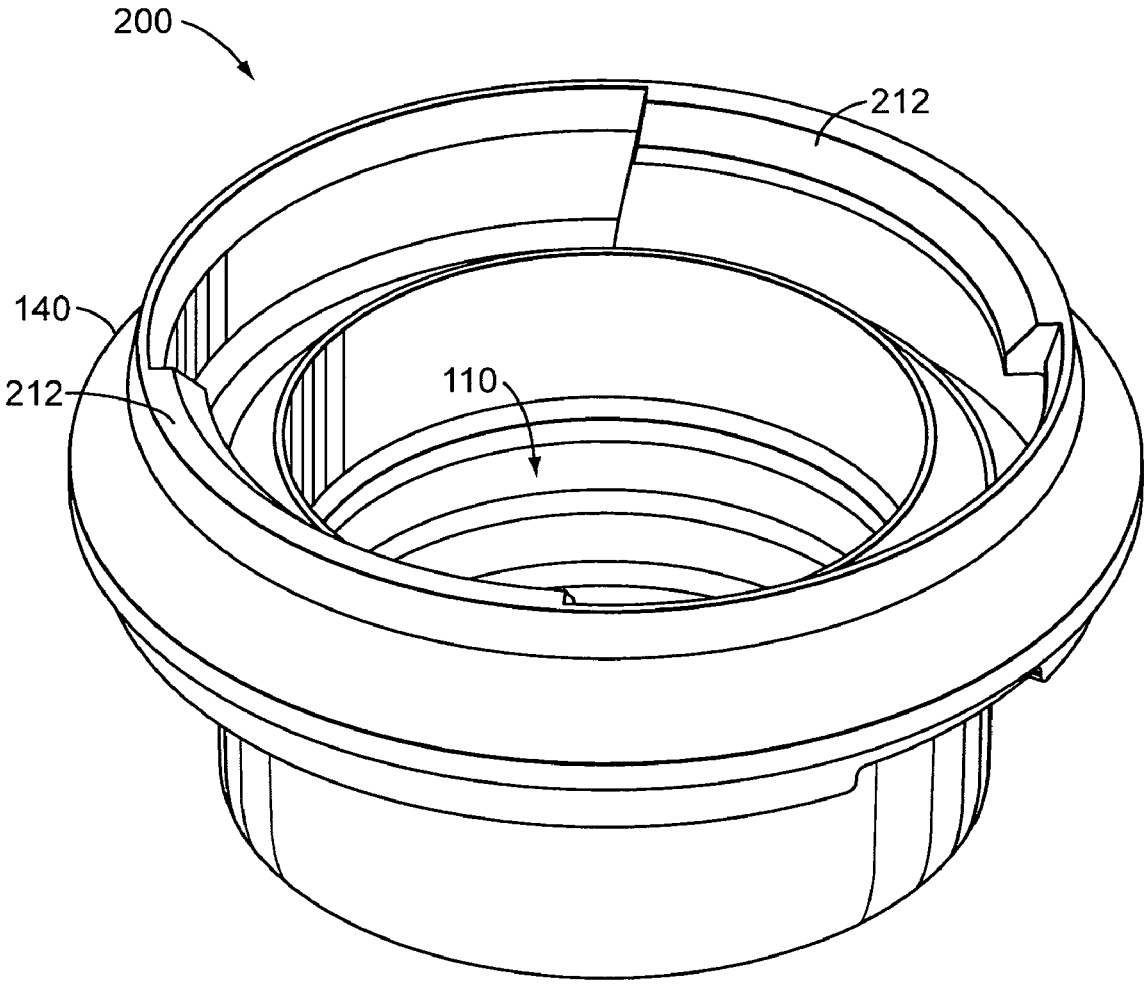
FIG. 13 is a top perspective view of a second form of a carrier ring prior to assembly with other components shown in FIG. 12.
Figure 14:
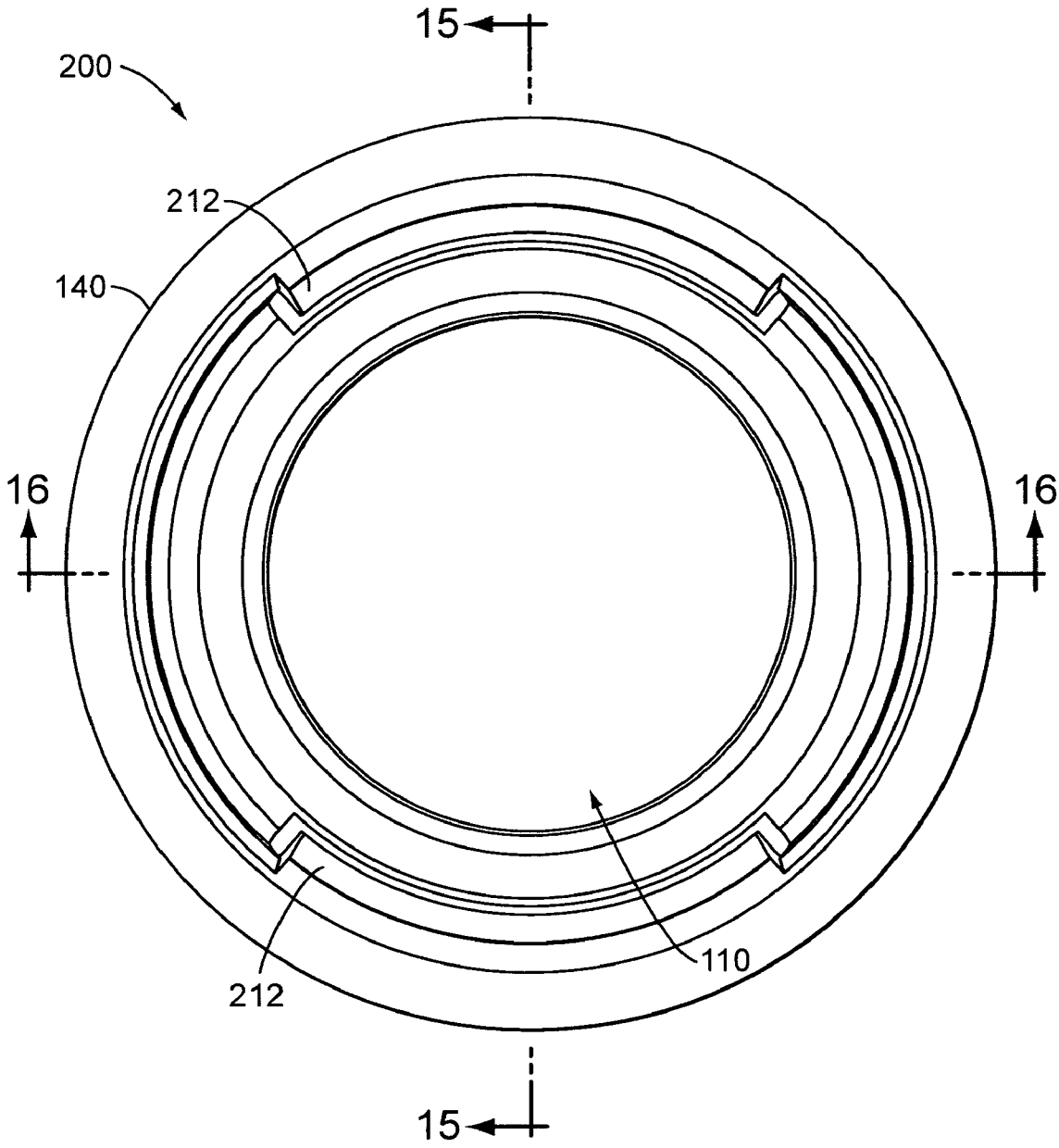
FIG. 14 is a top view of the carrier ring of FIG. 13.
Figure 15:
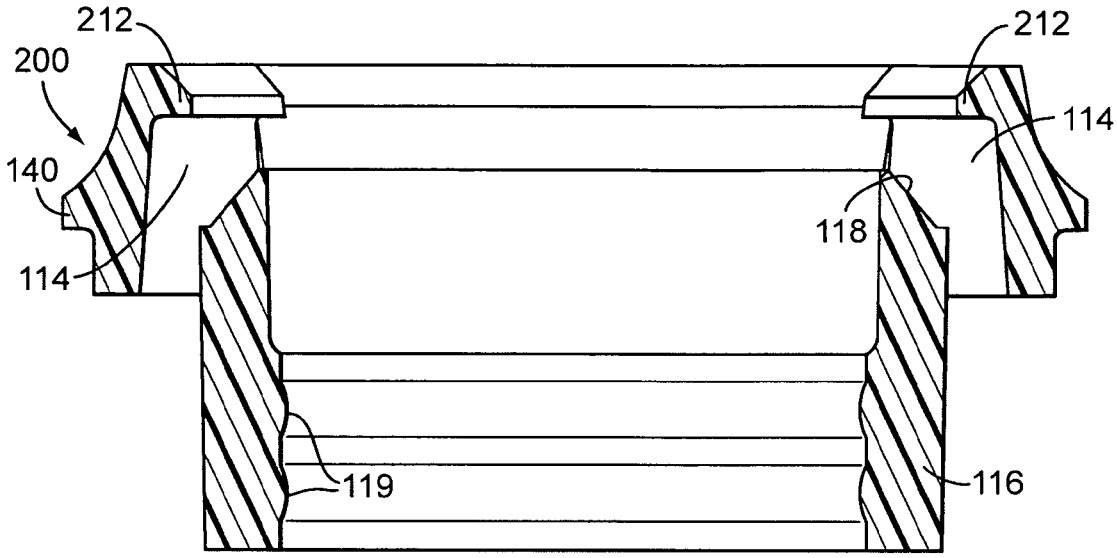
FIG. 15 is a cross-sectional view of the carrier ring taken along line 15-15 of FIG. 14.
Figure 16:
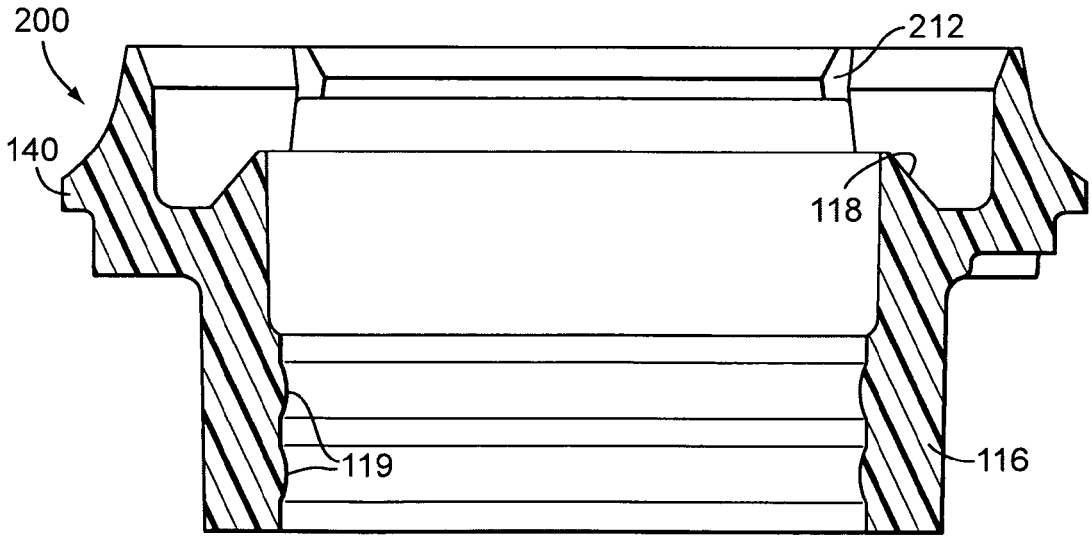
FIG. 16 is a cross-sectional view of the carrier ring taken along line 16-16 of FIG. 14.
Figure 17:
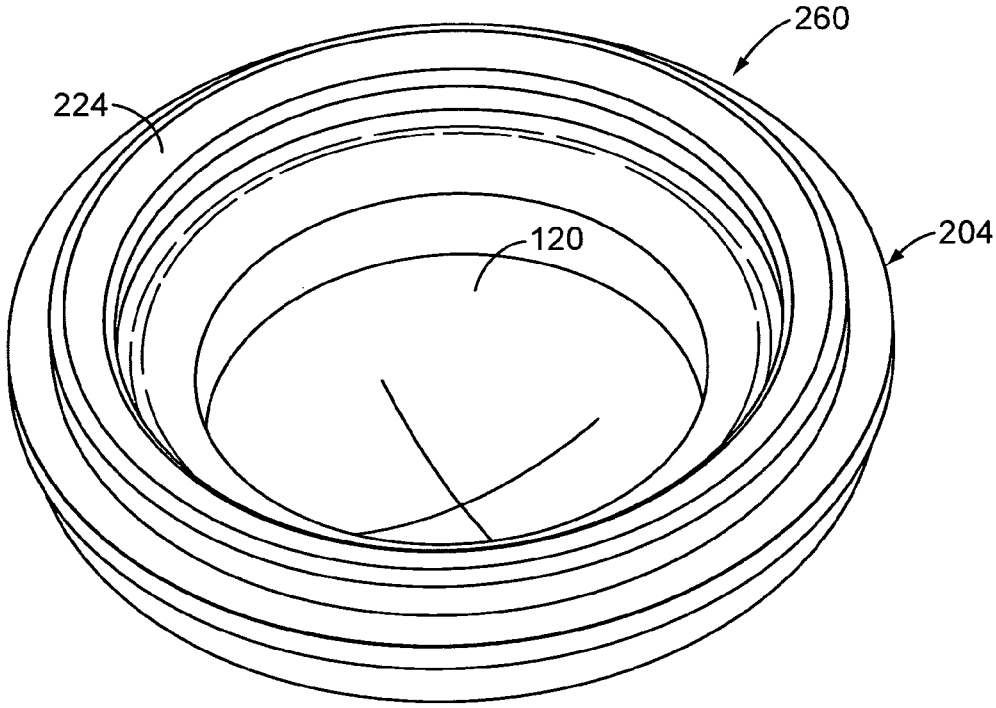
FIG. 17 is a top perspective view of a second form of a valve for use with the second form of the carrier ring shown in FIG. 12.
Figure 18:
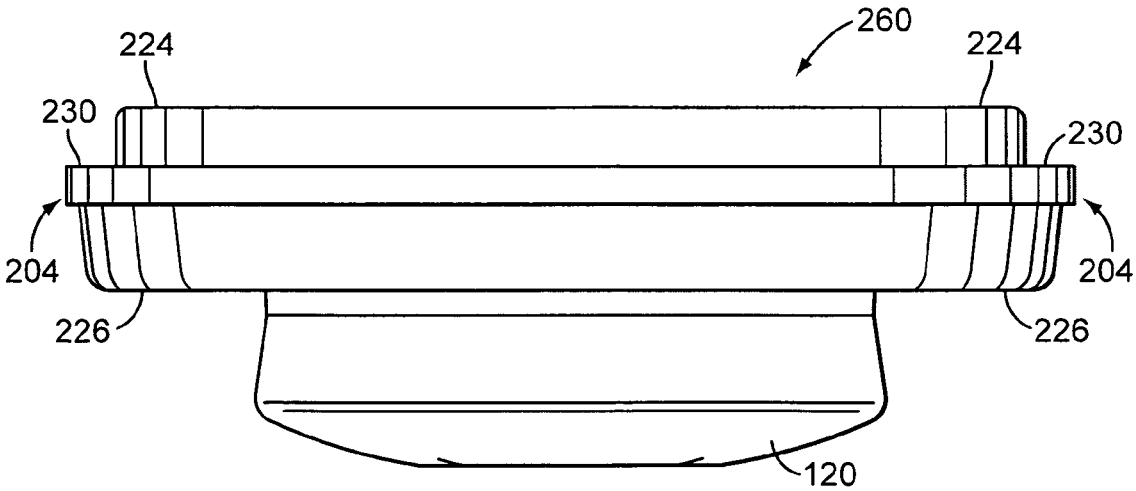
FIG. 18 is a side elevational view of the valve of FIG. 17.
Figure 19:
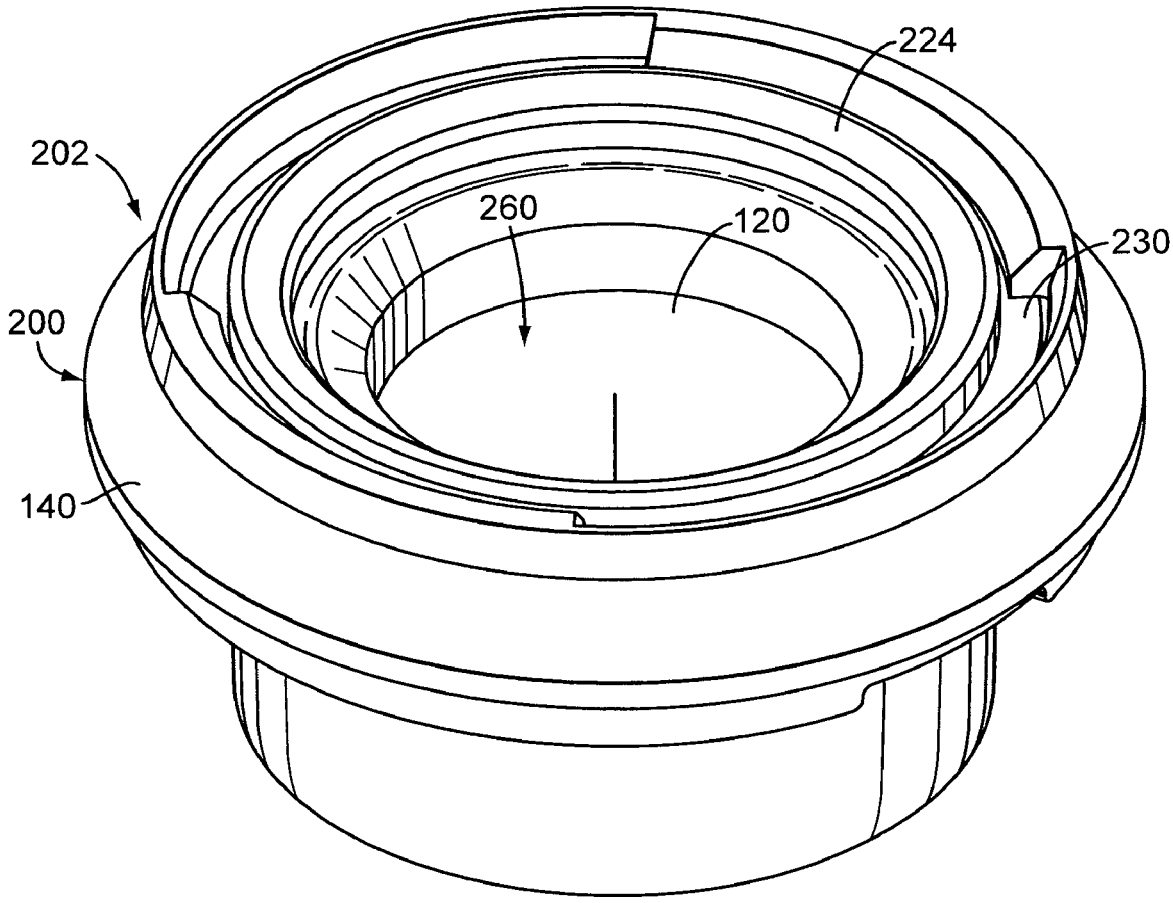
FIG. 19 is a top perspective view of an assembled carrier ring assembly which includes the carrier ring of FIGS. 13-16 and the valve of FIGS. 17-18.
Figure 20:
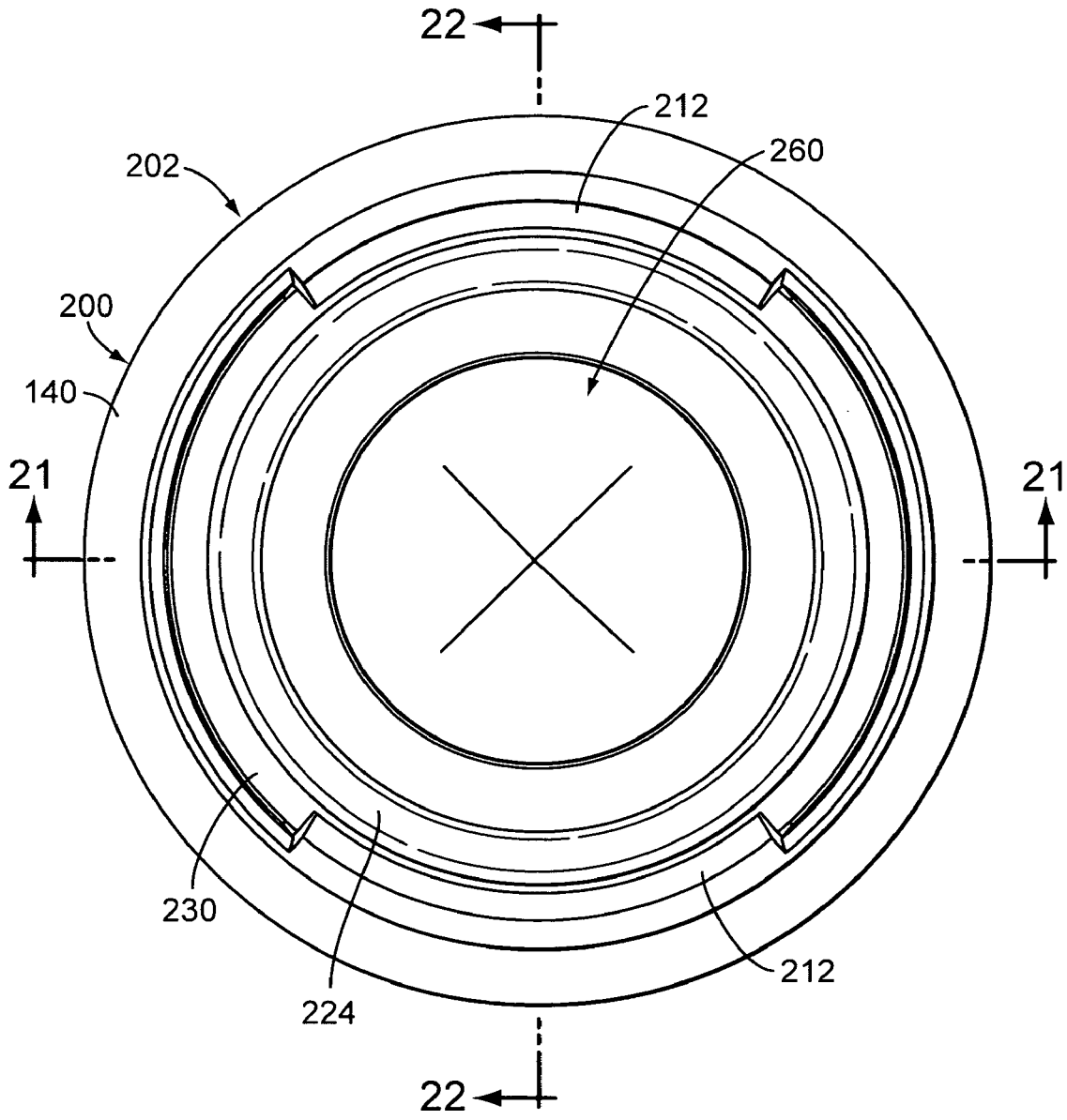
FIG. 20 is a top view of the assembled carrier ring assembly of FIG. 19.

A carrier ring assembly 202, comprising a valve 260 and carrier ring 200, is illustrated as inserted into the closure 36 in FIG. 12. The structures of both the valve 260 and the carrier ring 200 are different in this embodiment compared to the above-discussed first embodiment valve 60 and carrier ring 100, respectively. Specifically, the retention portion 204 of the valve 260 and the retention beads 212 of the ring 200 have been modified. The retention portion 204 is best seen in FIGS. 17, 18, 21, and 22. In this embodiment, the retention portion 204 of the valve 260 has the shoulder 230 located outwardly of both the closure sealing surface 224 and the carrier ring sealing surface 226 wherein no portion of the valve 260 extends over the shoulder 230. Additionally, as best seen in FIGS. 14-15, the retention beads 212 are located vertically higher on the carrier ring 200 than the first embodiment retention beads 112 on the carrier ring 100 (FIGS. 4-5).

Figure 21:
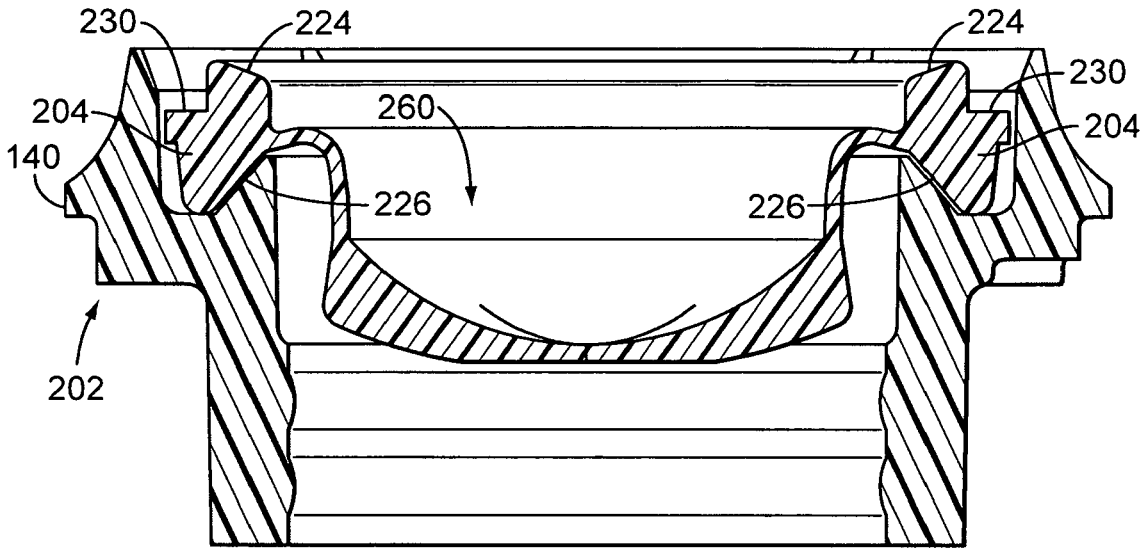
FIG. 21 is a cross-sectional view of the assembled carrier ring assembly taken along line 21-21 of FIG. 20.
Figure 22:
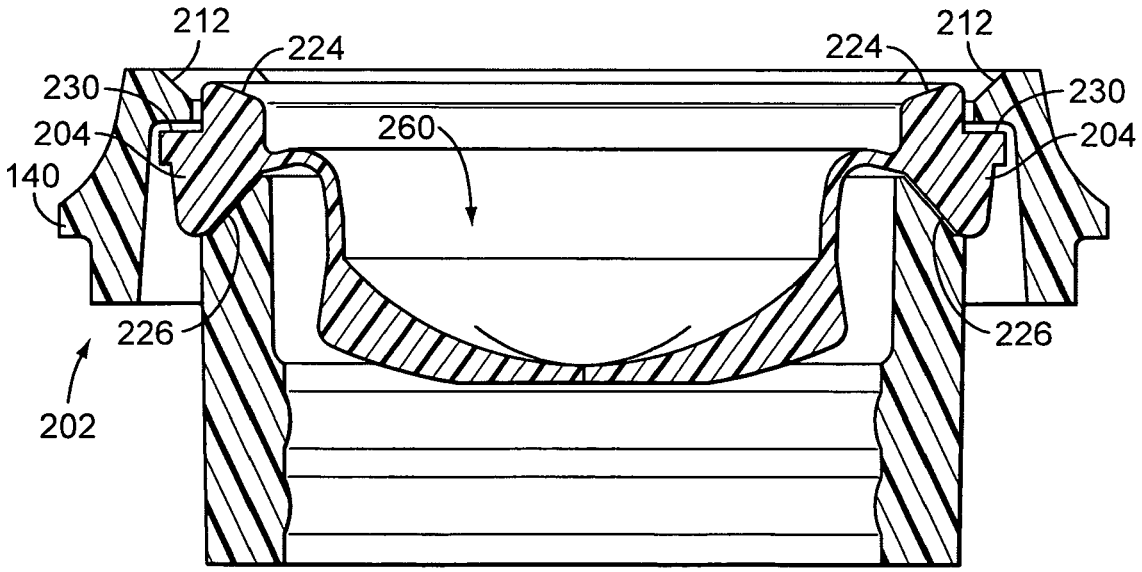
FIG. 22 is a cross-sectional view of the assembled carrier ring assembly taken along line 22-22 of FIG. 20.

The valve 260 is inserted down into the carrier ring 200 in a manner similar to the process explained above with respect to the first embodiment illustrated in FIGS. 1-11, and this creates a carrier ring assembly 202 (FIGS. 21 and 22). The valve shoulder 230 is moved past the retention beads 212 whereby the retention beads 212 will retain the valve 260 within the carrier ring 200. However, as explained for the first embodiment supra, the shoulder 230 need not contact or be compressed by the retention beads 212.

The carrier ring assembly 202 is inserted into the closure 36 in a manner similar to that explained supra with respect to the first embodiment. The carrier ring assembly 202 is retained within the closure 36 by the snap-fit engagement of the carrier ring flange 140 with the closure body bead 142 (FIG. 12). The closure sealing surface 224 of the valve 260 contacts the spout sealing surface 256 of the closure 36, and the carrier ring sealing surface 226 of the valve 260 contacts the top portion 118 of the wall 116 of the carrier ring 200.

It should be understood that while the embodiments described supra disclose the beads 112 and 212 located near the top of the respective carrier ring assemblies 102 and 202, it should be understood that the beads 112 and 212 may be located lower in the carrier ring assemblies 102 and 202, and the outer periphery of the valve 260 would have an annular groove or recess or shoulder located in a lower position to accommodate the lowered beads.

Figure 23:
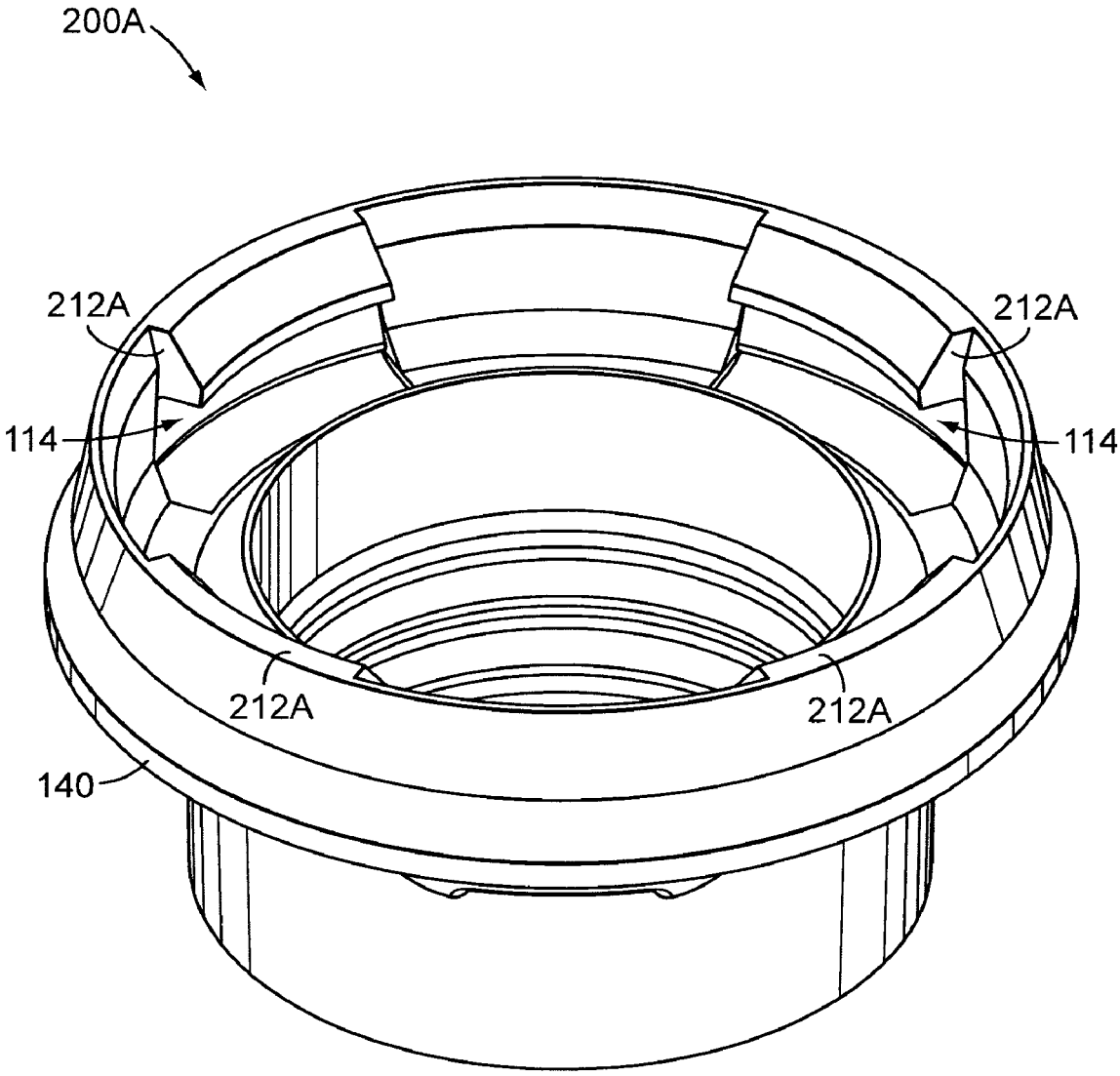
FIG. 23 is a top perspective view of a third form of a carrier ring prior to assembly with other components.

FIG. 23 shows a third embodiment of the carrier ring which can be used to carry or hold a valve, such as the valve 60 described above with reference to FIGS. 17 and 18, in a closure, such as the closure 36 described above with reference to FIG. 12. The carrier ring is generally designated with the reference number 200A in FIG. 23 and can be regarded as a modification of the second embodiment of the carrier ring 200 described above with reference to FIG. 13. The modification in the third embodiment of the carrier ring 200A can be generally described as employing four, circumferentially spaced retention beads 212A instead of just two retention beads 212 used in the second embodiment of the carrier ring 200 illustrated in FIG. 13.

Figure 24:
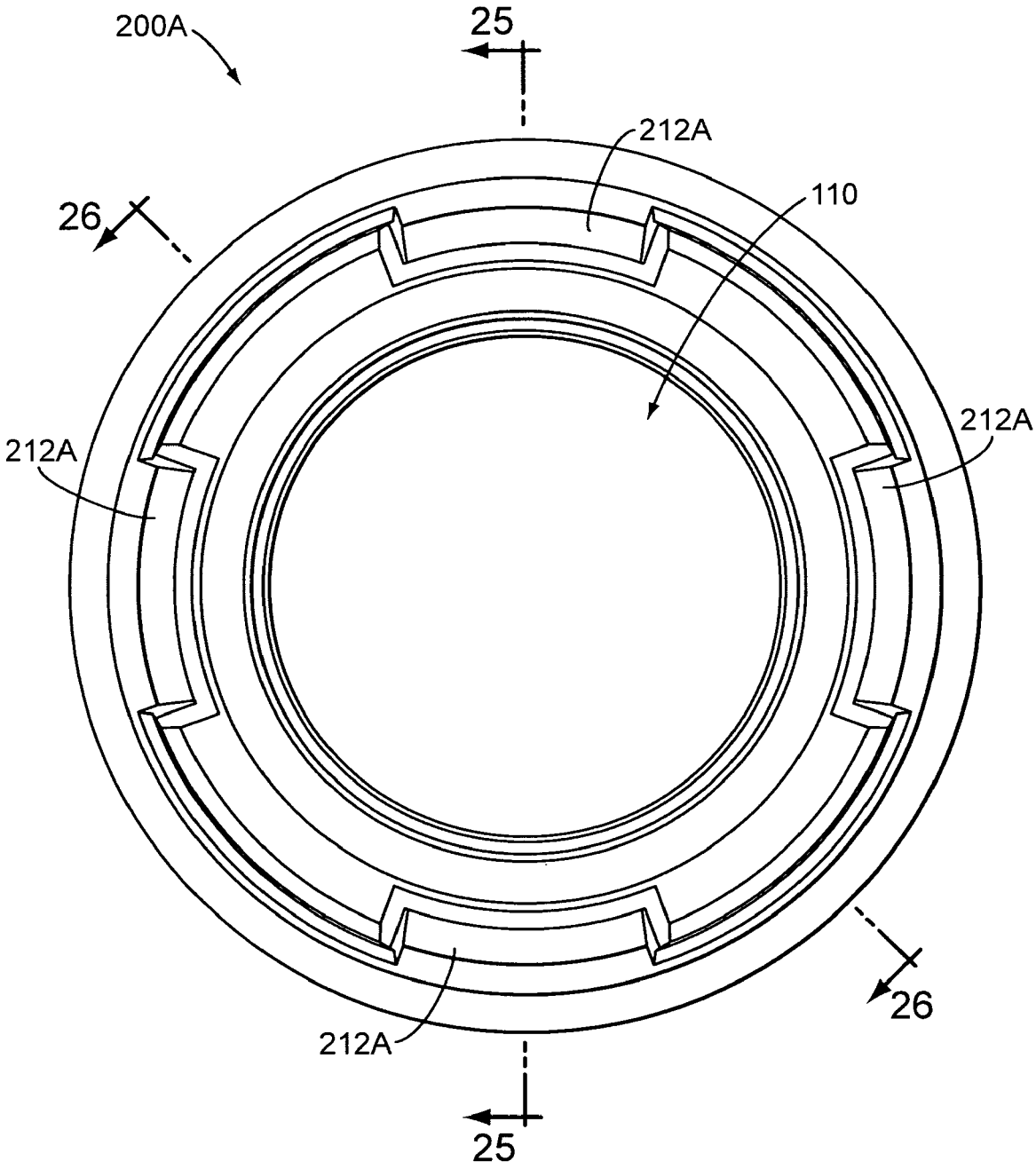
FIG. 24 is a top view of the carrier ring of FIG. 23.
Figure 25:
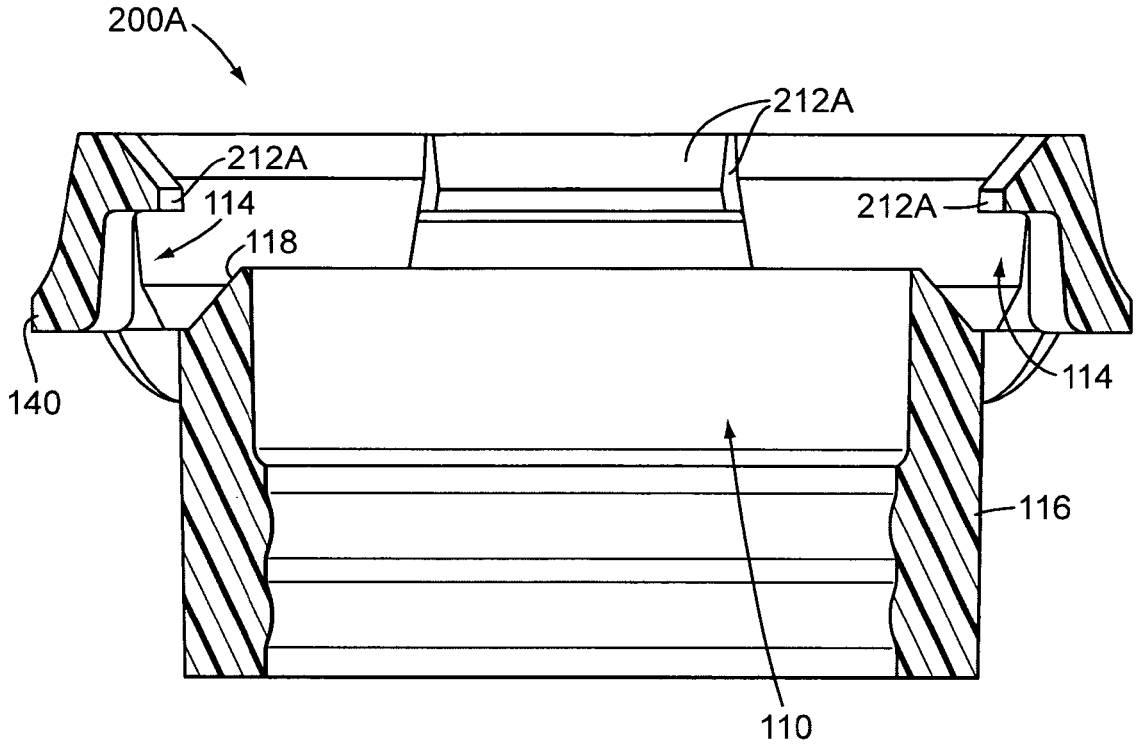
FIG. 25 is a cross-sectional view of the carrier ring taken along line 26-26 of FIG. 24.

The retention beads 212A are disposed around a dispensing passage 110 (FIG. 24). As can be seen in FIG. 25, under each retention bead 212A, there is a retention spaced 114.

Figure 26:
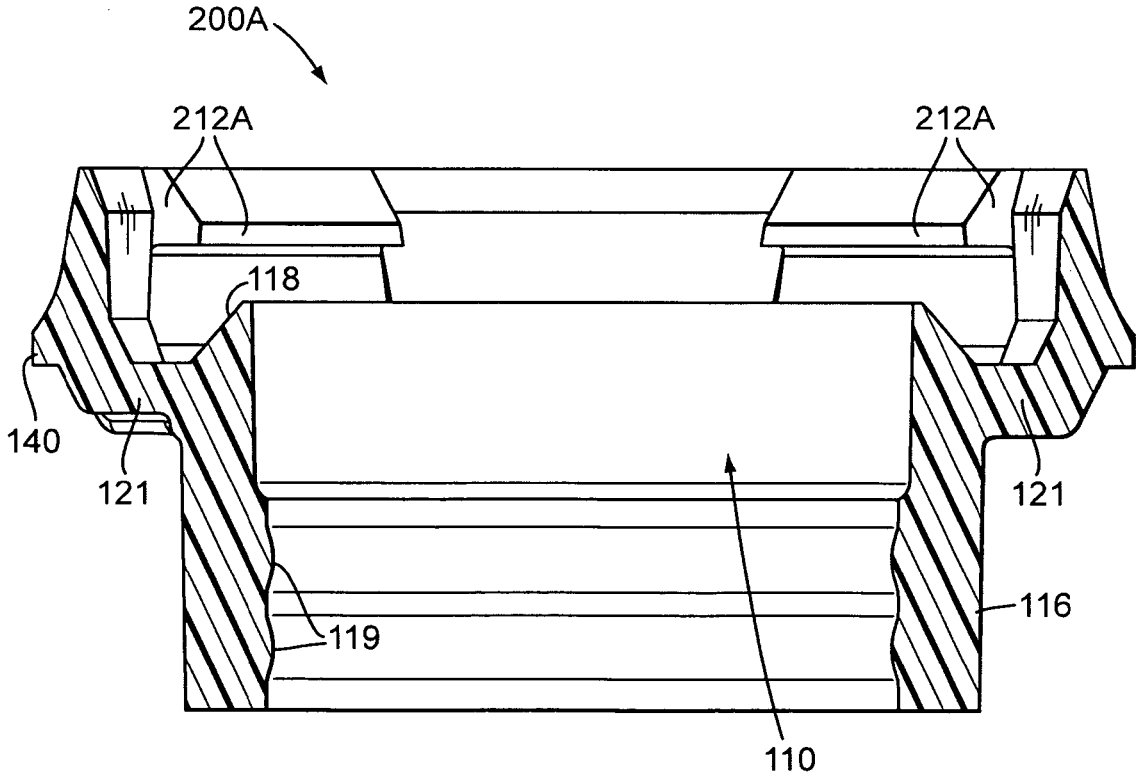
FIG. 26 is across-sectional view of the carrier ring taken along line 26-26 of FIG. 24.
Figure 27:
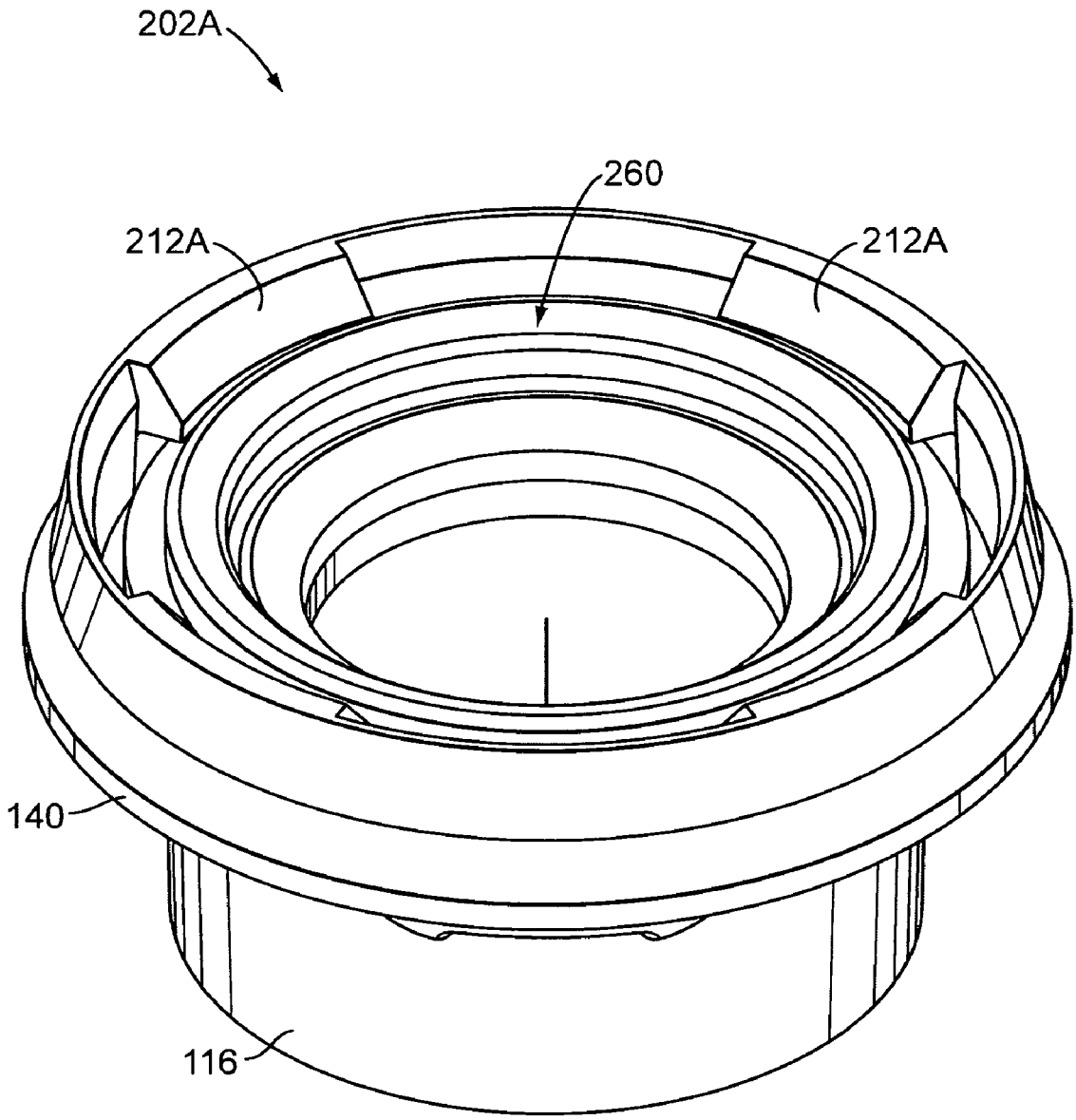
FIG. 27 is a top perspective view of an assembled carrier ring assembly which includes the carrier ring of FIGS. 23-26 and the valve of FIGS. 17-18.
Figure 28:
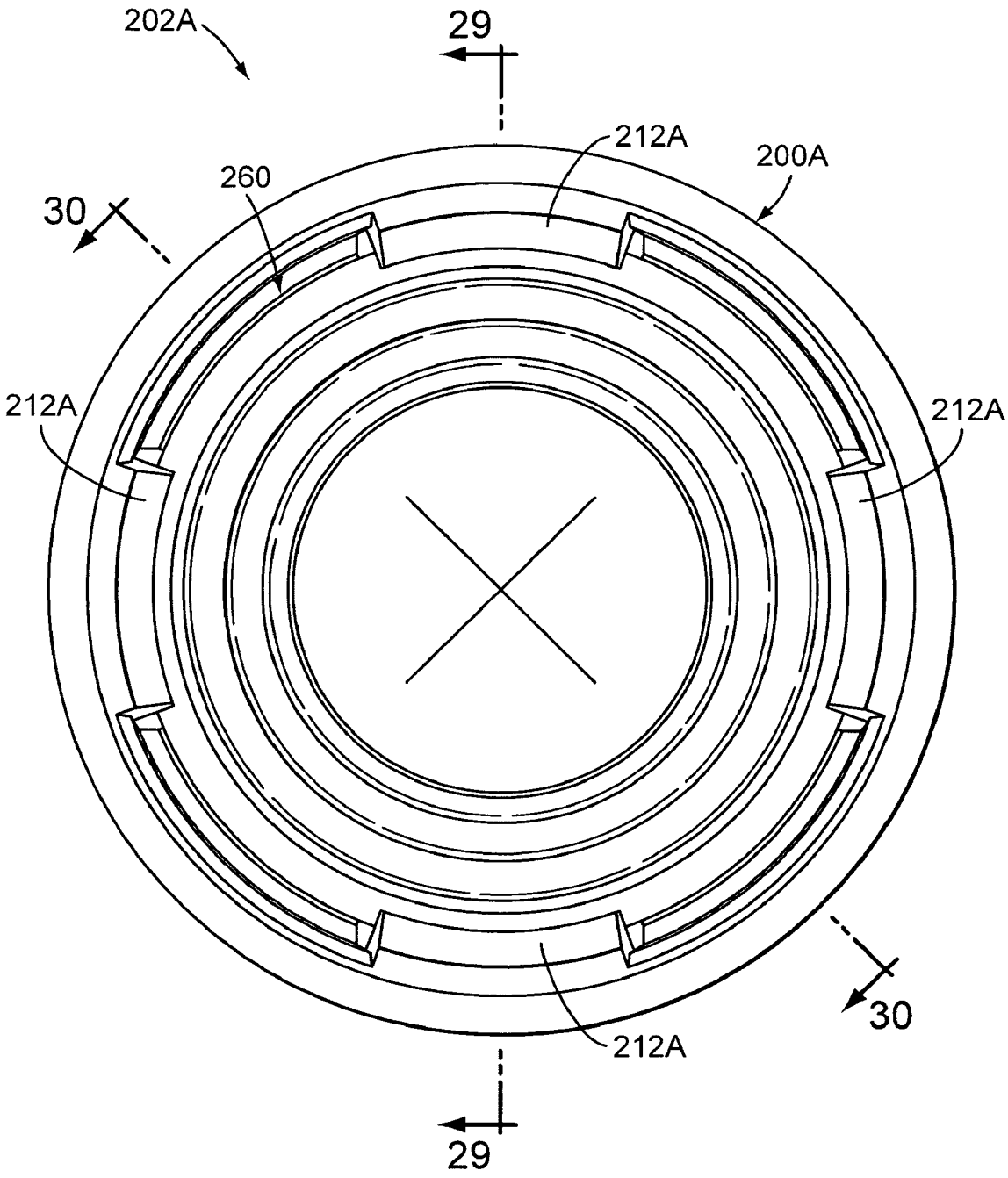
FIG. 28 is a top view of the assembled carrier ring assembly of FIG. 27.

As seen in FIGS. 25 and 26, the dispensing passage 110 is defined by a wall 116 having a top portion 118. The wall 116 also includes beads 119 which facilitate retention of the ring 200A on the mold assembly core component when the mold is opened after the thermoplastic material has been injected and cooled sufficiently.

The top portion 118 of the wall 116 is frustoconical. The beads 212A are located adjacent the top portion 118 of the wall 116. Each retaining space 114 is defined at least in part by the top portion 118 of the wall 116 and one retaining bead 212A. Furthermore, as understood from FIGS. 23 and 26, the carrier ring 200A is preferably a unitary structure. Specifically, while it might appear from a cursory inspection of FIG. 25 that the retaining beads 212A are detached from the wall 116, it should be understood from FIG. 26 that the retaining beads 212A are, in fact, indirectly attached to the wall 116 through bridges 121 as a unitary structure.

The exterior of the carrier ring 202A has an outwardly extending annular flange 140 (FIGS. 23 and 26).

The valve 260 is inserted into the carrier ring 200A in a manner similar to the process explained above with respect to the second embodiment illustrated in FIGS. 12-22, and this creates a carrier ring assembly 202A (FIGS. 27-30). The valve shoulder 230 (FIG. 29) is moved past the retention beads 212A whereby the retention beads 212A will retain the valve 260 within the carrier ring 200A. However, the valve shoulder 230 need not contact, or be compressed by, the retention beads 212A.

The carrier ring assembly 202A can next be inserted into a closure, such as the closure 36 described above with reference to the first and second embodiments illustrated in FIGS. 1-22. In particular, the assembly 202A is inserted into the closure body 46 (from the bottom end of the closure body 46). The carrier ring flange 140 contacts the snap-fit bead 142 on the engagement structure or collar 144 located on the inside of the closure body 46 (as explained above for the second embodiment with reference to FIG. 12). As the carrier ring assembly 202A is urged past the closure body bead 142, the carrier ring flange 140 contacts the bead 142, thereby retaining the carrier ring assembly 202A within the closure body 46.

Figure 29:
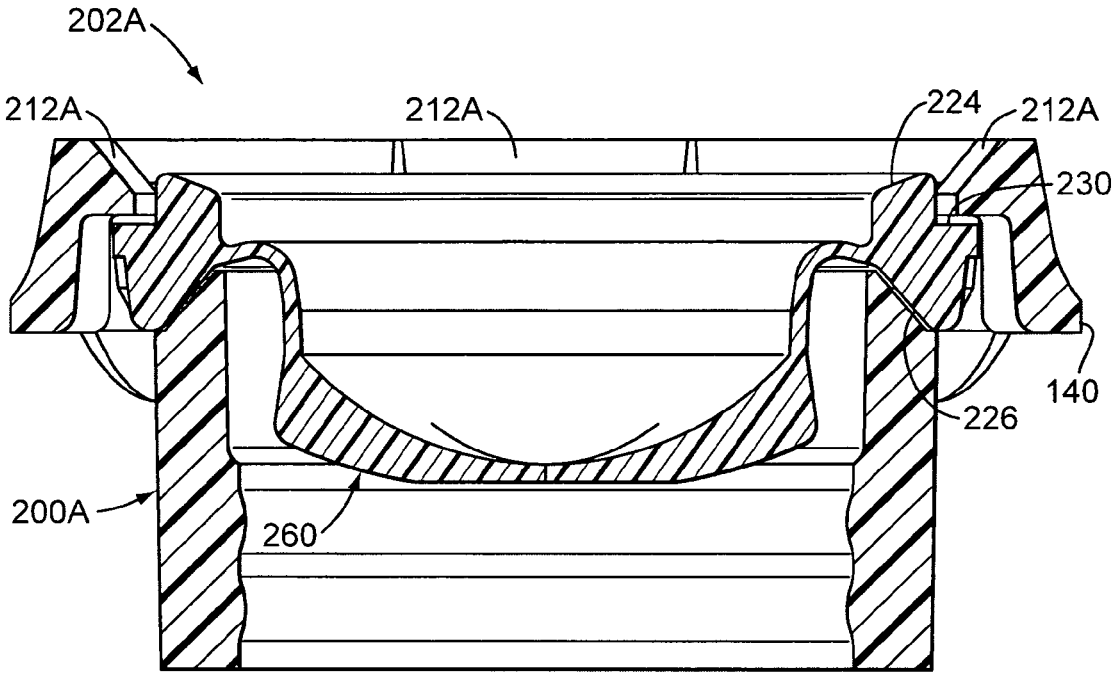
FIG. 29 is a cross-sectional view of the assembled carrier ring assembly taken along line 29-29 of FIG. 28.
Figure 30:
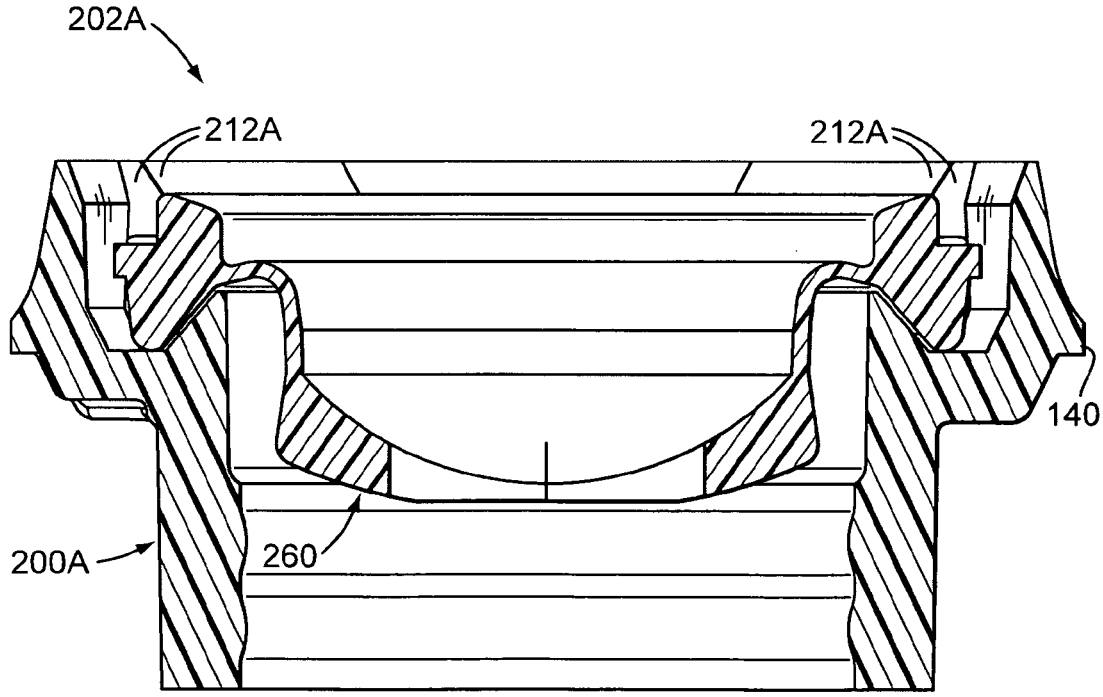
FIG. 30 is a cross-sectional view of the assembled carrier ring assembly taken along line 30-30 of FIG. 28.

The carrier ring assembly 202A is retained within the closure 36 by the snap-fit engagement of the carrier ring flange 140 with the closure housing bead 142. As can be seen in FIG. 29, the closure sealing surface 224 of the valve 260 (FIG. 29) can contact the spout sealing surface 256 of the closure 36, and the carrier ring sealing surface 226 of the valve 260 (FIG. 29) contacts the top portion 118 of the wall 116 of the carrier ring 200A.

It will be readily apparent from the foregoing detailed description of the invention and from the illustrations thereof that numerous variations and modifications may be effected without departing from the true spirit and scope of the novel concepts and principles of this invention.

What is claimed is:

1. A closure for an opening to a container, the closure comprising:

a hollow body for engaging the container around the opening and having a dispensing opening for communicating with the container opening; and a valve carrier ring assembly located within the body adjacent the dispensing opening and having a carrier ring and a valve, the carrier ring including a dispensing passage, a plurality of circumferentially spaced, separate retaining beads and a plurality of retaining spaces, the dispensing passage defined by a wall having a top portion, the plurality of retaining beads each located adjacent the top portion of the wall, each retaining space defined at least in part by the top portion of the wall and one of the plurality of retaining beads, the valve located at least partially within the carrier ring and including a dispensing portion and a retention portion, at least part of the retention portion located substantially within the plurality of retaining spaces and wherein the carrier ring is a unitary structure, wherein said carrier ring further includes a plurality of circumferentially spaced bridges corresponding in number to said plurality of retaining beads, each of said bridges respectively positioned between adjacent ones of said retaining beads, said bridges indirectly connecting said retaining beads to said top portion of said wall.

2. The closure of claim 1 wherein said plurality of separate retaining beads of the carrier ring includes four separate retaining beads spaced in a circular locus on the carrier-ring, and four circumferentially spaced ones of said bridges.

3. The closure of claim 1 wherein the carrier ring includes two separate retaining beads, and the retaining beads are located oppositely, in diametrically opposed relationship, on the carrier ring.

4. The closure of claim 1 wherein the valve retention portion is resilient to facilitate assembly.

5. The closure of claim 1 wherein the top portion of the wall is generally frustoconical.

6. The closure of claim 1 wherein the valve is loosely retained in the retaining spaces at least prior to installation of the valve carrier ring assembly in the closure hollow body.

7. The closure of claim 1 wherein the at least part of the retention portion comprises a recessed outer shoulder portion.

8. The closure of claim 1 further comprising at least one closure retaining bead located on the hollow body to retain the hollow body adjacent the valve carrier ring assembly in the hollow body.

9. The closure of claim 8 further comprising a valve contacting surface defined by the closure hollow body wherein the valve is compressed between the valve contacting surface and the top portion of the wall.

10. A closure for an opening to a container, the closure comprising:

a hollow body for engaging the container around the opening and having a dispensing opening for communicating with the container opening; and a valve carrier ring assembly located within the body adjacent the dispensing opening and having a carrier ring and a valve, the carrier ring including a dispensing passage, a plurality of circumferentially spaced retaining beads and a corresponding plurality of retaining spaces, the dispensing passage defined by a wall having a top portion, the retaining beads located adjacent the top portion of the wall, the retaining spaces defined at least in part by the top portion of the wall and the retaining beads, the valve located at least partially within the carrier ring and including a dispensing portion and a retention portion, the retention portion having a closure sealing surface, a carrier ring sealing surface, and a shoulder portion located between the closure sealing surface and the carrier ring sealing surface, at least a part of the retention portion positioned within the at least one retaining space and wherein the carrier ring is a unitary structure, wherein said carrier ring further includes a plurality of circumferentially spaced bridges corresponding in number to said plurality of retaining beads, each of said bridges respectively positioned between adjacent ones of said retaining beads, said bridges indirectly connecting said retaining beads to said top portion of said wall.

11. The closure of claim 10 wherein said plurality of retaining beads of the carrier ring includes four separate retaining beads, and four circumferentially spaced ones of said bridges.

12. The closure of claim 11 wherein the retaining ring includes two separate retaining beads, and the retaining beads are located oppositely, in diametrically opposed relationship, on the carrier ring.

13. The closure of claim 10 wherein the valve retention portion is resilient to facilitate assembly.

14. The closure of claim 10 wherein the top portion of the wall is generally frustoconical.

15. The closure of claim 10 wherein the valve is loosely retained in the retaining spaces at least prior to installation of the valve carrier ring assembly in the closure hollow body.

16. The closure of claim 10 wherein the at least part of the retention portion comprises a recessed outer shoulder portion.

17. The closure of claim 10 wherein the closure sealing surface is an upwardly facing frustoconical surface for contacting the closure and the carrier ring sealing surface is a downwardly facing frustoconical surface for contacting the carrier ring.

18. The closure of claim 10 further comprising at least one closure retaining bead located on the closure hollow body to retain the valve carrier ring assembly in the hollow body.

19. The closure of claim 18 further comprising a spout that is defined by the closure body and that has a spout sealing surface wherein the valve is compressed between the spout sealing surface and the top portion of the wall.

* * * * *